United States Patent [19]

Pritchett

[11] Patent Number: 4,744,381

[45] Date of Patent: May 17, 1988

[54] CENTER POLE LODGE

[76] Inventor: Wayne Pritchett, 1820 Sherwood St., Missoula, Mont. 59802

[21] Appl. No.: 839,158

[22] Filed: Mar. 13, 1986

[51] Int. Cl.[4] ..... E04H 15/14; E04H 15/26; E04H 15/24

[52] U.S. Cl. ..... 135/93; 135/99; 135/100

[58] Field of Search ..... 135/98, 91, 93, 94, 135/99, 100, 20 A, 20 M, 117

[56] References Cited

U.S. PATENT DOCUMENTS

| | | | |
|---|---|---|---|
| 32,481 | 6/1861 | Landell | 135/93 |
| 33,934 | 12/1861 | Ellis | 135/93 X |
| 39,777 | 9/1863 | Fullan | 135/98 |
| 809,516 | 1/1906 | Mann | 135/93 X |
| 1,123,657 | 1/1915 | Bache | 135/93 |
| 1,198,935 | 9/1916 | Lorimer | 135/99 X |
| 1,428,343 | 9/1922 | Runcie | 135/93 |
| 1,543,134 | 6/1925 | Todd | 135/98 X |
| 1,753,666 | 4/1930 | Ryder | 135/20 A |
| 2,147,872 | 2/1939 | Wittcoff | 135/93 X |
| 2,796,877 | 6/1957 | Berseth | 135/100 |
| 3,181,543 | 5/1965 | Petrie | 135/99 X |
| 3,889,698 | 6/1975 | Roessl | 135/94 |
| 3,953,949 | 5/1976 | O'Sheeran | 135/100 X |

FOREIGN PATENT DOCUMENTS

| | | | |
|---|---|---|---|
| 602502 | 9/1934 | Fed. Rep. of Germany | 135/20 A |
| 3143 | of 1915 | United Kingdom | 135/20 A |
| 0732709 | 6/1955 | United Kingdom | 135/100 |

*Primary Examiner*—Robert A. Hafer
*Assistant Examiner*—D. Neal Muir
*Attorney, Agent, or Firm*—Lane & Aitken

[57] ABSTRACT

A ventilating system for a tepee includes an uppermost portion of a wall of a tepee, a substantially horizontally disposed opening defined by a top of the uppermost portion, a support disposed above a center of the opening, and a cone-shaped cap having a vertex, a base and a pivot point located on a top side of the wall, wherein the pivot point is rotatably supported by the support and wherein a bottommost portion of the base, opposite from the pivot point, rests on an outer annular surface of the uppermost portion, such that the cap is rotatable about the support.

8 Claims, 14 Drawing Sheets

FIG.3
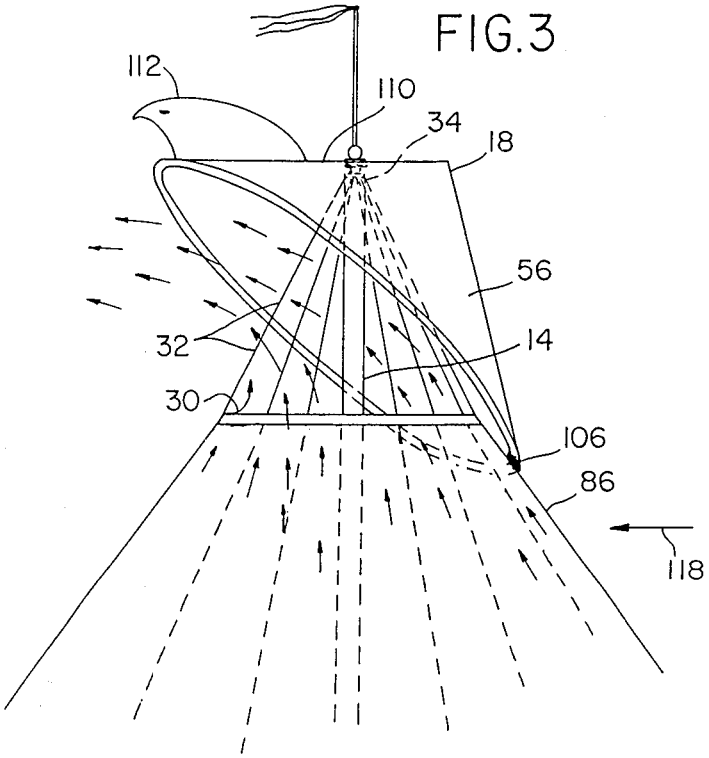
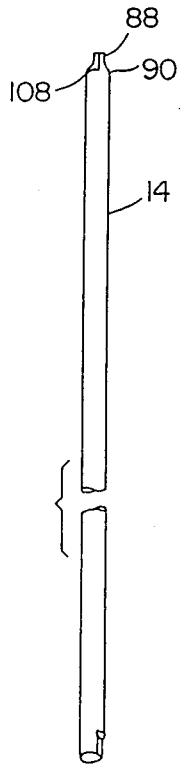
FIG.6
FIG.4
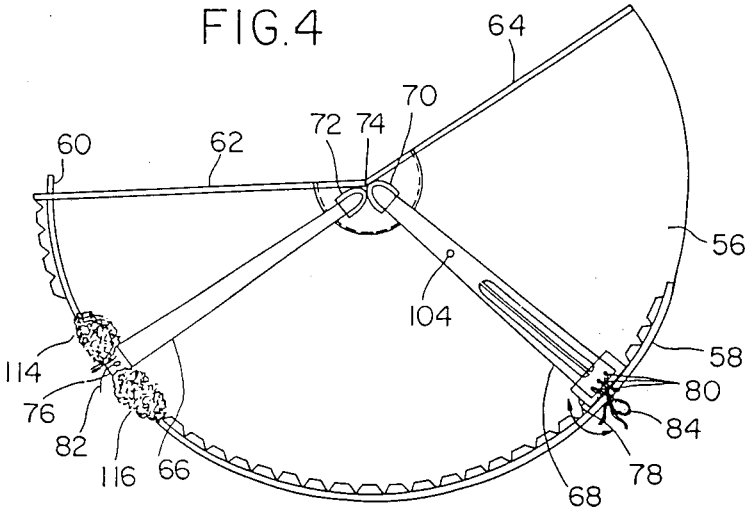
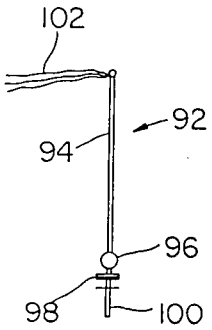
FIG.5

FIG.15
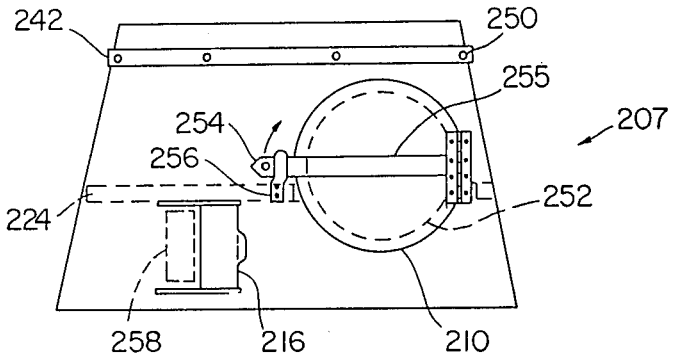
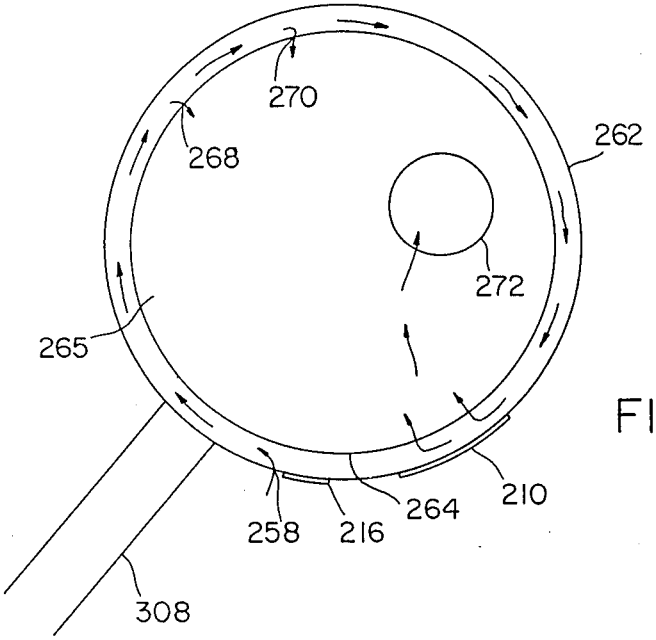
FIG.16
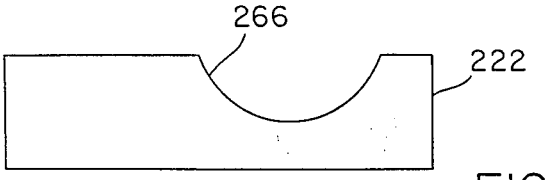
FIG.17

FIG. 18
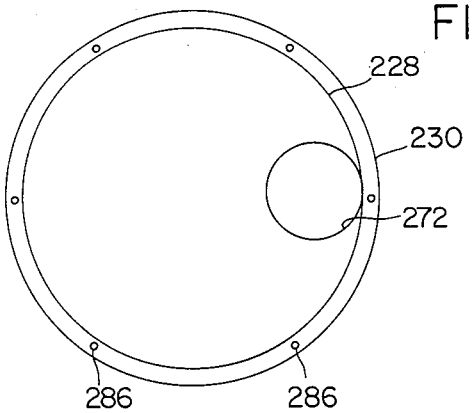
FIG. 21
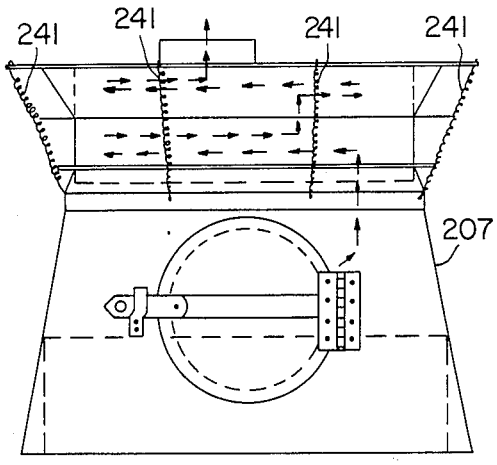
FIG. 19
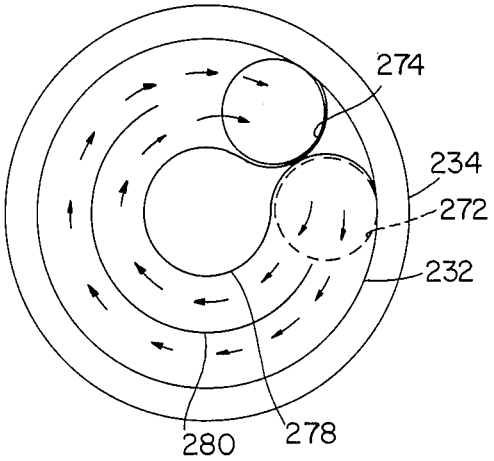
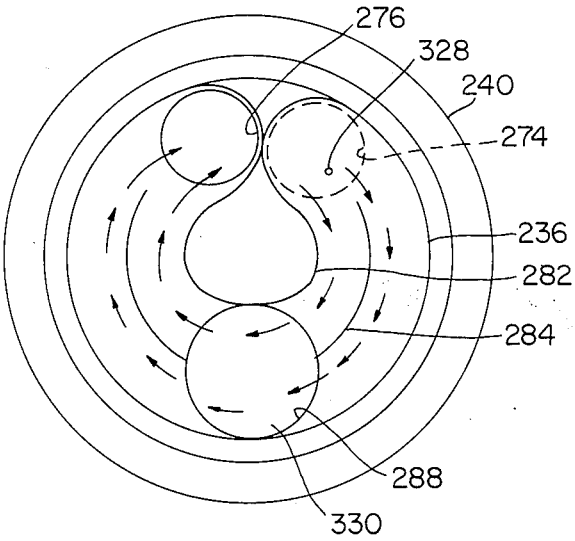
FIG. 20

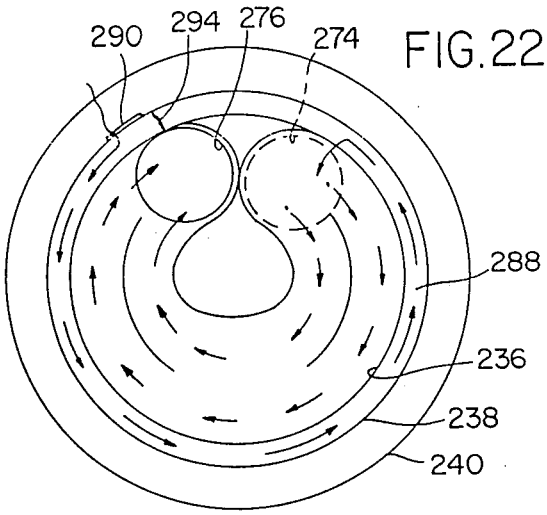
FIG. 22
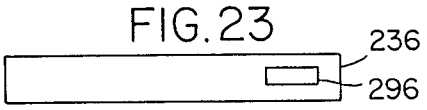
FIG. 23
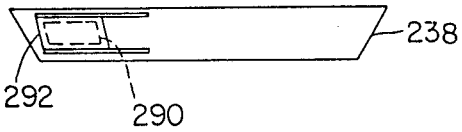
FIG. 24
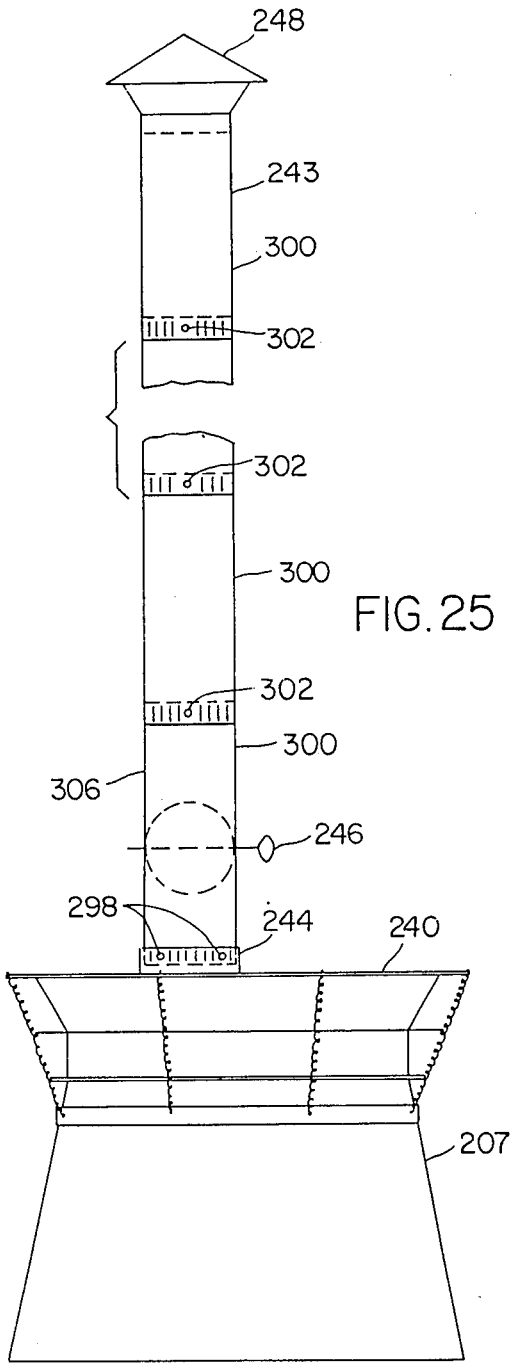
FIG. 25
FIG. 26
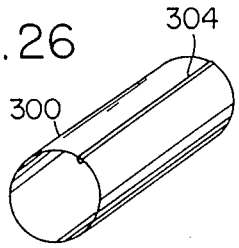
FIG. 27
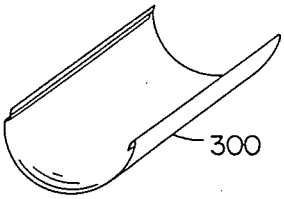

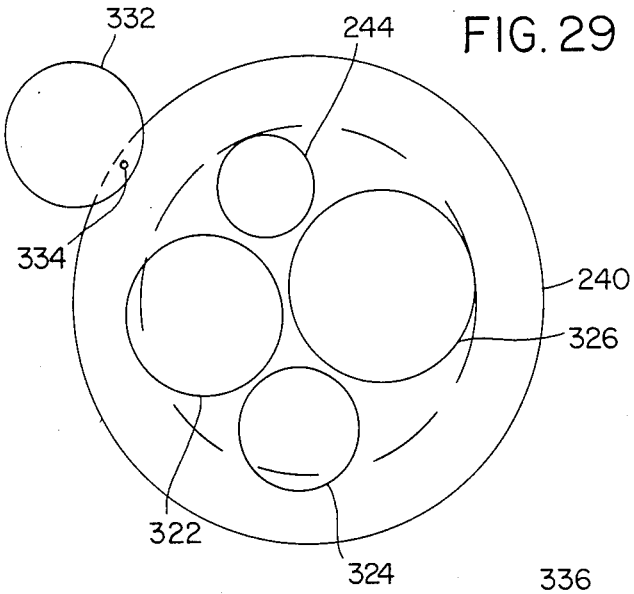
FIG. 29
FIG. 30
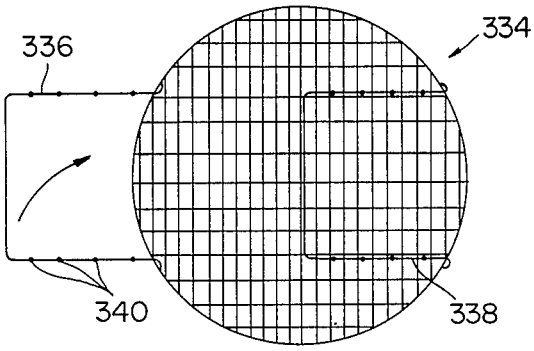
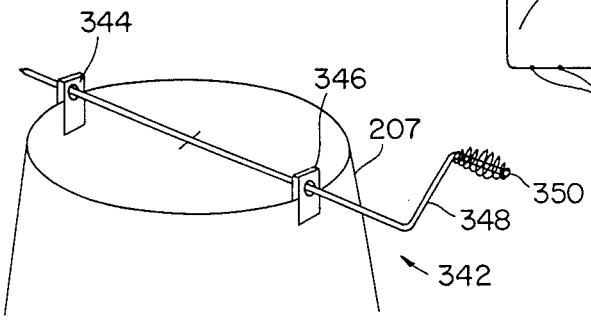
FIG. 32
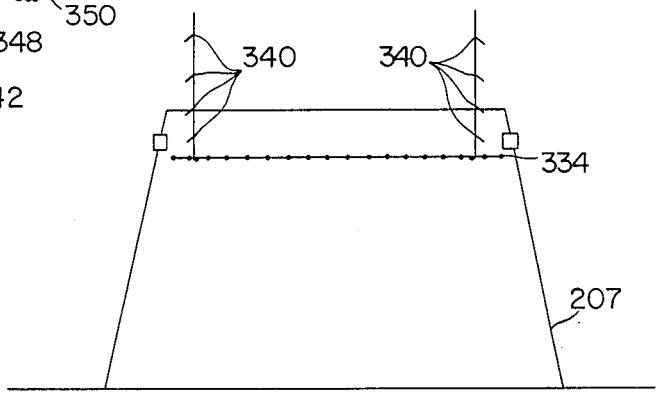
FIG. 31

CENTER POLE LODGE

BACKGROUND OF THE INVENTION

Generations have passed since man was truly at one with nature, as evidencd by modern man's dwellings. Modern man insists upon permanent, enclosed and artificial "boxes" for homes, and such structures are imposed upon the land not only for primary dwellings but for second and third homes, motels, hotels and, though less permanent, mobile homes as well. In so doing, man has destroyed a wealth of natural resources, interfered with the ecology of many living things, and jeopardized his own mental and physical health, leaving behind a devastation that may well have serious ramifications for generations to come.

This present condition has been due in no small measure to the greater comforts and conveniences of modern dwellings, luring man from his embrace of the earth to encapsulated fortresses. There is thus an as yet unfulfilled need for efficient, secure, light-weight, compactible and portable dwellings that do not harm man or nature and at the same time allow a comfortable, attractive life. It is to this overall objective that the present invention is directed.

In arriving at this overall goal, a number of collective achievements are required. In the specific context of the present invention, these include a cone-cap for a center pole lodge that provides improved ventilation, improved rotational mobility in response to changes in wind direction, and lessened fire hazard; a band tie-down system that is simple, adaptable to various terrains, versatile and easy to use; a stake that is simple yet efficient, lightweight, compactible, strong and adaptable to varying ground conditions; a stake-marking compass that is simple, easy to use and highly accurate; and a stove that is airtight, efficient, lightweight, compactible, portable, versatile and aesthetically pleasing.

SUMMARY OF THE INVENTION

In accordance with the present invention, a cone-cap, tie-down system, stake, stake-marking compass and stove are provided that meet the above-stated requirements. A ventilating system for a tepee is provided, comprising an uppermost portion of a wall of a tepee, a substantially horizontally disposed opening defined by a top of the uppermost portion, a support disposed above a center of the opening, and a coneshaped cap having a vertex, a base, a wall and a pivot point disposed on a top side of the wall, wherein the pivot point is rotatably supported by the support and wherein a bottommost portion of the base opposite from the pivot point rests on an outer annular surface of the uppermost portion, such that the cap is rotatable about the support. The invention also involves a band tie-down system for a tent, a stake, a stake-marking compass and a stove. The invention also involves related methodology.

In addition to satisfying the above-stated requirements, the present invention achieves many other significant advantages, as will be readily apparent from the following detailed discussion.

BRIEF DESCRIPTION OF THE DRAWINGS

FIG. 3 is a perspective view of a cone-cap.

FIG. 4 is a bottom view of the cone-cap of FIG. 3 in a disassembled condition.

FIG. 5 is a perspective view of an antenna assembly.

FIG. 6 is a perspective view of a center pole.

FIG. 15 is a front view of a main body of the stove of FIG. 14.

FIG. 16 is a bottom view of the main body of FIG. 15, including an associated air channel.

FIG. 17 is a side view of a wall of the channel of FIG. 16.

FIG. 18 is a bottom view of a first plate and rim assembly.

FIG. 19 is a bottom view of a second plate and rim assembly.

FIG. 20 is a bottom view of a third plate and rim assembly.

FIG. 21 is a front view of a portion of the stove of FIG. 14, with arrows indicating circulation.

FIG. 22 is a bottom view of the assembly of FIG. 21, with a preheater channel illustrated in greater detail.

FIGS. 23 and 24 are side views of walls of the channel of FIG. 22.

FIG. 25 is a front view of a smoke-stack assembly.

FIGS. 26 and 27 are perspecitve views of pieces of the smoke-stack assembly of FIG. 25.

FIG. 29 is a plan view of a cooking surface.

FIG. 30 is a plan view of a grill.

FIG. 31 is a side view of the grill of FIG. 30.

FIG. 32 is a perspective view of a roasting spit.

DETAILED DESCRIPTION OF THE PREFERRED EMBODIMENTS

The lodge of this invention is designed to be used in all climatic conditions, from the artic and the antarctic to the equator and in all possible terrains. In any of these situations, the lodge makes possible a controllable and comfortable atmosphere.

Figure 1:
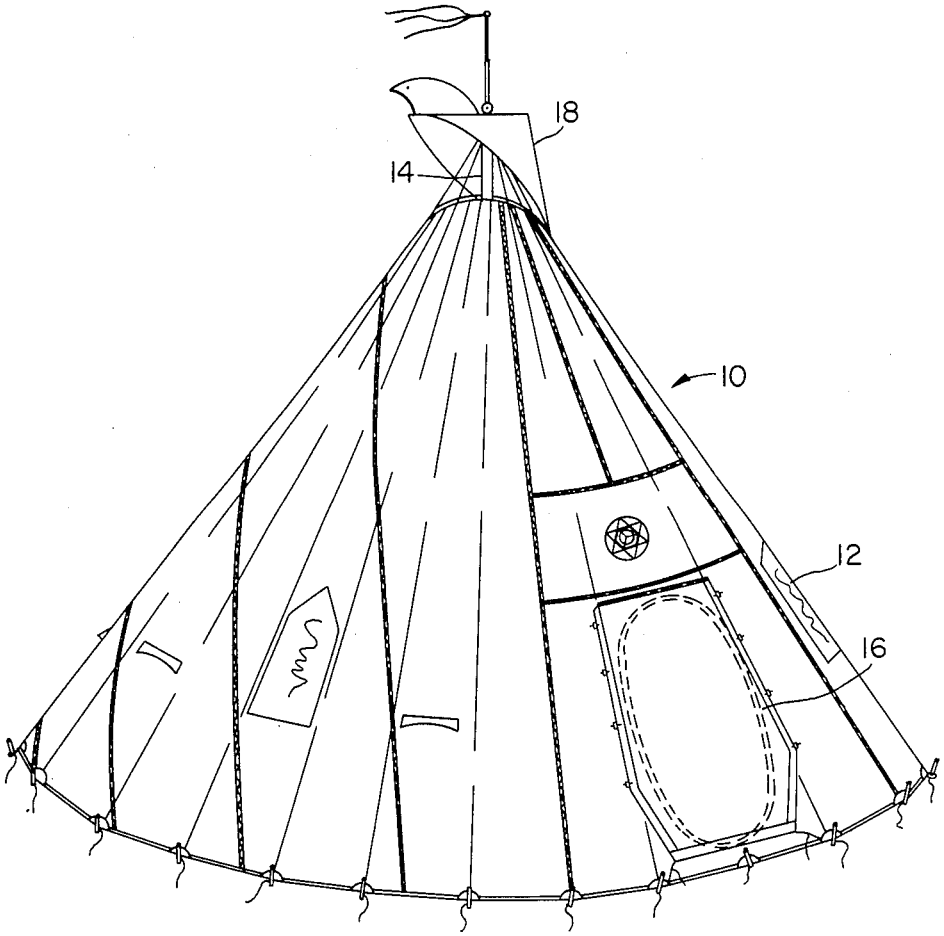
FIG. 1 is a perspective view of a center pole lodge in accordance with the invention.
Figure 2:
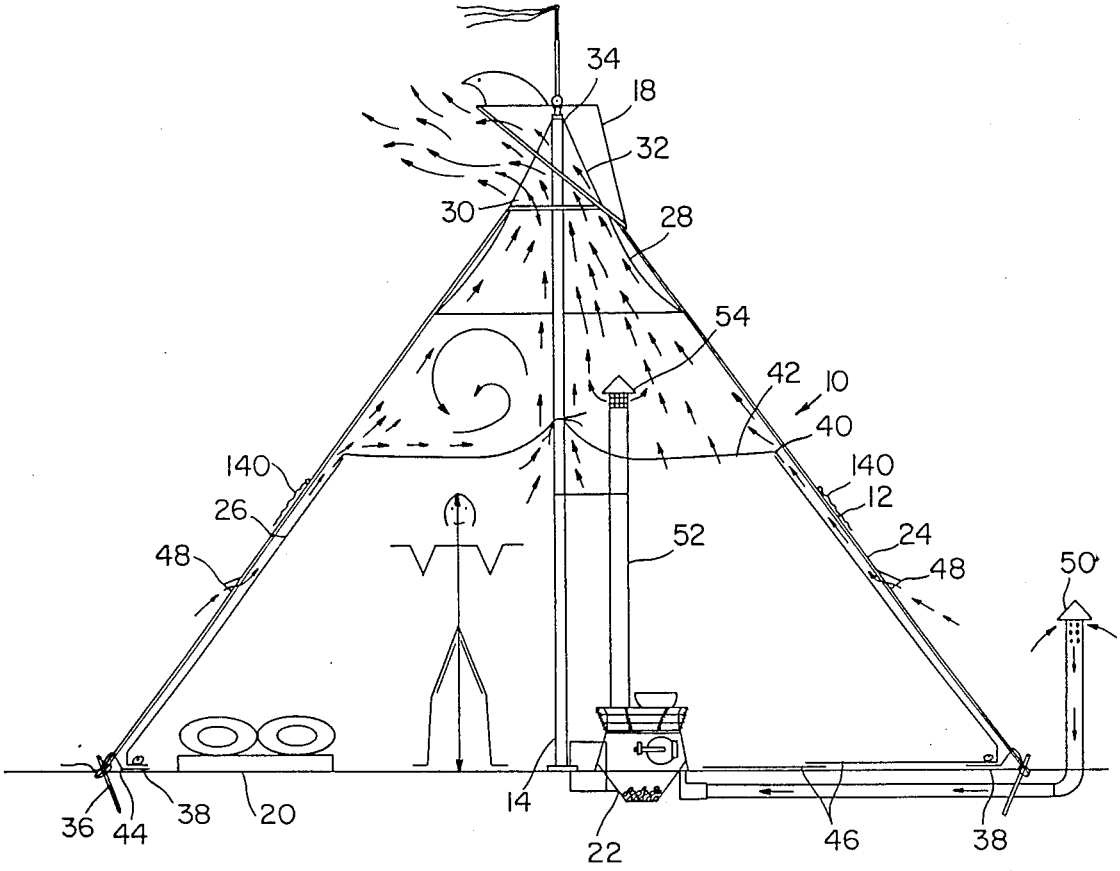
FIG. 2 is a side view of the lodge of FIG. 1, with one side of the lodge cut away.

As depicted in FIG. 1, the present invention involves a tent structure of the tepee type, provided with a wall 12, generally having a cone shape, a center pole 14 providing support for the wall, a door 16 disposed in the wall, and a cone-cap 18 supported at the top of the tent. As depicted in FIG. 2, the lodge is sized to accomodate a bed 20, a stove 22 and an ample amount of usable space. In the depicted embodiment, the diameter of the lodge at its base is approximately 20 feet, 7 inches, and its height is approximately 15 feet.

At the center of the lodge is pole 14. The pole is selected such that it is sturdy enough to support the wall of the tent and any camp items that may be affixed to it. A suitable material is lodge-pole pine or any other wood having sufficient strength. The pole is also suitably made from aluminum pipe sectioned into six 2½ foot lengths with sleeve couplings. An external pole tripod can also be used, the lodge apex then being suspended by a sufficiently strong cord or rope.

Wall 12 actually consists of an outer wall or skin 24, a liner 26, and a smoke-hole liner 28. The outer wall 24 is preferably composed of a polyester-Teflon/Gortex laminate. As with all of the materials used in the tent, fire-retardant fabrics are used. For different demands and requirements, the Center Pole Lodge lends itself readily to a variety of tent fabrics both traditional and modern. Expectations are that new fabrics will be created greatly enhancing the viability of the lodge, such as fabrics being nearly 100 percent fireproof, exhibiting near zero solar deterioration, being much longer lasting, and being safer, as well as having high strength and being lightweight, breathable, etc. Laminates of Kyvler, fiberglass or the like are suitable.

The windows, providing solar light and heat, and door, are suitably positioned in the wall, and the uppermost portion of the tepee defines a substantially circular and horizontally disposed opening 30. In a preferred embodiment, the wall is formed from a circular piece of material having a radius of 17 feet, 6 inches, with a radially defined section constituting 5/12 of the total area removed, and then with a broken circular section defined by a 21 inch radius removed from the center of the piece.

Liner 26 provides an airspace between it and outer wall 24, providing an insulating airspace and also serving to reflect heat to thus retain it within the tent. The liner is suitably composed of a fire-resistant, lightweight drapery fabric having a heat reflective quality. The liner is removed or replaced with mosquito metting, if desired, in warm weather. The liner is supported as is wall 24, by a plurality, for example 28, radiating bands 32. The bands are each secured at one end to an apex ring 34 and at another end to a respective stake 36. In a preferred embodiment, every other band is terminated adjacent to smoke-hole 30, and each terminated band is secured to a cross-band that is in turn affixed to two bands on either side of the terminated band. By providing a greater amount of liner material than outer wall material between each band, the liner sags to a controlled extent away from wall 24 to thus produce the insulating airspace. Weight 38 helps to keep the bottom of the liner in place.

Radiating bands 32, in a preferred embodiment, are composed of ⅜ inch polyester, hollow-braided, non-elastic cord of 400 pound test and are adjustable in length. Each band is affixed to a respective stake in such a way that the bottom of the skin and annular ground-skirt 44, which is sewn into the bottom hem of the skin, can be raised to provide ventilation without releasing the bands. The skin is affixed to the stakes by means of stainless steel tie-down rings. In a preferred embodiment, each tie-down ring is disposed along a bottom hemline of the skin, in the center of a semi-circular reinforcement hem having a five-inch radius. A V-shaped support attachment extends from an area adjacent to the semi-circular reinforcement hem, near the top of the reinforcement hem, to the skin tie-down ring. Circular protective flaps are attached to the bottom of the skin to cover the tie-down ring, reinforcement hem, and stake in one embodiment to prevent icing up of the tie-downs. In this embodiment, a hole is provided in the protective flap through which the uppermost portion of the stake may protrude.

At top 40 of the liner, it adjoins with secondary ceiling 42. The secondary ceiling extends generally horizontally from liner 26 to the center pole. Above the secondary ceiling, smoke-hole liner 28, suitably composed of fibreglass cloth, is affixed to wall 24 in the same way that liner 26 is affixed. Smoke-hole liner 28 is fireresistant and prevents spark damage and also soot accumulation on the lodge skin. The smoke-hole liner is simply removed for easy cleaning.

The ground enclosed by the tent is covered to fit the requirements of the user. A variety of floor systems adaptable to varied ground and climatic conditions are suitable. A convenient, all-around, general purpose floor system, as depicted in FIG. 2, consists of using many small, breathable ground cloths, rugs or mats 46, each one overlapping the other's edges by about 6 inches or more and the outer edge, around the perimeter of the floor, overlapping by at least 6 to 8 inches the lodge ground skirt 44, which is sewn into the base-hem of the lodge wall. Weights 38 such as camp items or rocks are utilized to press overlaps together, these effectively sealing from air infiltration and most unwanted animals. This floor system permits easy, individual removal of floor sections for shaking out and airing to clean the floor, without the need to remove everything from the lodge, plus the convenience of transporting and variable decorating schemes.

Breathability of the ground covering is preferred so the ground may dry out and remain so, preventing condensation and dampness from occuring underneath that would support mildew, fungus and insects, etc. Dried grass or leaves may be placed under the ground cloths for good insulation.

The Center Pole Lodge is especially notable for its dryness even in severe rain conditions. The breathable polyester-Gortex wall-skin waterproof to 60 p.s.i. water pressure and while strong also permitting some diffused solar light, the windows, an effective entrance door system, efficient ventilating system, the ability to build a fire on the ground, all effectively aid in keeping the floor-ground very dry, assuming proper site selection.

Some other optional floor embodiments are suitable for extreme climatic-environmental conditions, such as tropical wet, infested zones or wet snow, ice zones. A water proof, continuous, one-piece floor is sewn in one embodiment onto the lodge's wall base-hem. Another attachment method is that of zippering in the floor piece, for easy removal to clean. More economically, lacing is used to lace together the floor piece and the lodge skin ground skirt or base hem.

The lodge is provided with a controllable, highly efficient ventilation system. Vents 48 are disposed about skin 24 allowing air to pass thereinto and upward within the insulating airspace, as indicated by the arrows in FIG. 2. In an alternative embodiment, vents 48 are disposed about skin placed above the liner, secondary ceiling level, so as not to affect the insulating value of the air space formed between the wall liner and outer skin. Air below secondary ceiling 42, if desired, can also pass through an opening or openings in the the secondary ceiling, as indicated by the arrows. When the stove is operated, and to maintain a stable interior atmosphere, air is introduced by air inlet 50, carried throughout the stove system, and upward through stovepipe 52. At the top of the stove-pipe, a spark-disintegrator and heat-disbursing stack cap 54 is provided, and heated air from the stove is released at this point, above secondary ceiling 42. Air that is collected above the secondary ceiling is allowed to exit from smoke-hole 30.

A unique and important feature of the lodge is cone cap 18, as best depicted in FIGS. 3 to 5. The cap consists of a cone-shaped wall 56 that is provided with an outer sleeve 58 into which a hoop-stiffener rod 60 is inserted. The wall is composed of a suitable material such as polyester-Gortex fabric with Teflon on the inside. The hoop-stiffener, in a preferred embodiment, is a fiberglass rod having a diameter of from 5/16 to $\frac{5}{8}$ inches, and can be broken down into seven 16-inch sections for transport. Alternatively, the hoop-stiffener is composed of about six thin willow branches or the like, heliocoil wrapped with cord to form a stiff hoop.

FIG. 4 depicts the cone-cap in a flattened configuration, and in this configuration, the hoop can be removed and the cap collapsed and folded for transport. When edges 62 and 64 are joined, the cone-cap takes the configuration depicted in FIG. 3. When assembled as in FIG. 3, the base of the cone-cap has a diameter that allows it to provide optimum ventilation and prevent entry of rain and snow. When smoke-hole 30 has a diameter of 24 inches, the cone-cap preferably has a wall 32 inches wide and is prepared from a circular piece of material, as illustrated in FIG. 4, in which 120 degrees of material having been removed. In this way, the cone-cap extends horizontally beyond the periphery of smoke-hole 30 at all points of rotation.

Oak staves are secured to the cone-cap to provide further support. In the depicted cone-cap, two oak staves 66, 68 are provided, and in the assembled condition illustrated in FIG. 3, are located directly opposite from each other. The staves are inserted within respective stave pockets 70, 72 at the vertex 74 of the cone-cap and are secured adjacent to the sleeve of the cone-cap by oak stave and hoop-locking flaps 76, 78. The flaps are folded over a respective end of a stave, each end being provided with holes 80, and ties 82, 84 are laced through holes in the flap, cone-cap and hole 80 to secure the stave. In the depicted embodiment, the staves are tapered and have dimensions of $\frac{3}{8}$ inches by 2 inches by $29\frac{1}{4}$ inches.

The manner in which the cone-cap is affixed is best illustrated in FIG. 3. Uppermost portion 86 of outer wall 24 defines opening 30, and center pole 14 extends upward through the center of opening 30 such that the portion of the pole that extends through the opening is disposed above the center of the opening. As depicted in FIG. 6, center pole 14 is provided with a nipple 88 which, in the depicted embodiment, has a diameter of about one inch. The apex ring 34 to which radiating bands 32 are affixed has an internal diameter greater than the diameter of the nipple but less than the diameter of the remainder of the pole, such that the apex ring rests on shoulder 90 of the pole.

Antenna assembly 92 is illustrated in FIG. 5 and consists of antenna 94, eye-screw 96 which is welded to the antenna, washers 98 disposed below and restricted from upward movement by the eye-screw, and threaded portion 100 at the bottom of the assembly. Wind streamers 102 are affixed to indicate wind direction. The antenna may be grounded to serve as a lightening rod.

In order to affix the cone-cap to the top of the tent, pivot hole 104 is provided in stave 68 at a pivot point such that, when the cone-cap is assembled as depicted in FIG. 3, bottommost point 106 of the cap lightly engages uppermost portion 86 of the tent wall, about an outer annular surface as the cap is rotated. Threaded hole 108 is provided at the top of center pole 14 and, to assemble the cone-cap, washers 98 are first positioned above hole 108, pivot hole 104 is then positioned above washers 98, and threaded portion 100 is screwed into threaded hole 108. The washers sit atop center pole 14 and provide a seat for slide 110 of the cone-cap. This seat is 25 inches above opening 30 in the depicted embodiment. Preferably, washers are disposed both above and below the cone-cap and facilitate the swivel action of the cap. The eye-screw facilitates the screwing of the antenna assembly into threaded opening 108, since any small rod can be inserted into the eye-screw and used as a lever to rotate the antenna assembly.

By selecting the position of pivot hole 104 at a balanced point, top side 110 of the cone-cap is level and the cone-cap is allowed to swivel aerodynamically in response to changes in wind direction. Directional stabilizing fin 112 and fur sliders 114, 116, which are tack-stitched to either side of stave 66, facilitate the aerodynamic action of the cone-cap. Arrows in FIG. 3 illustrate the way in which air and smoke within the tent are drawn through opening 30 when the cone-cap has swivelled in response to a wind moving in the direction indicated by arrow 118.

The advantages of the cone-cap include improved ventilation, improved self-adjusting rotational mobility in response to changes in wind direction, collapsibility for transport, stability in erratic winds, lessened fire hazard, and convenience and economy of manufacture and affixation.

Figures 7, 8:
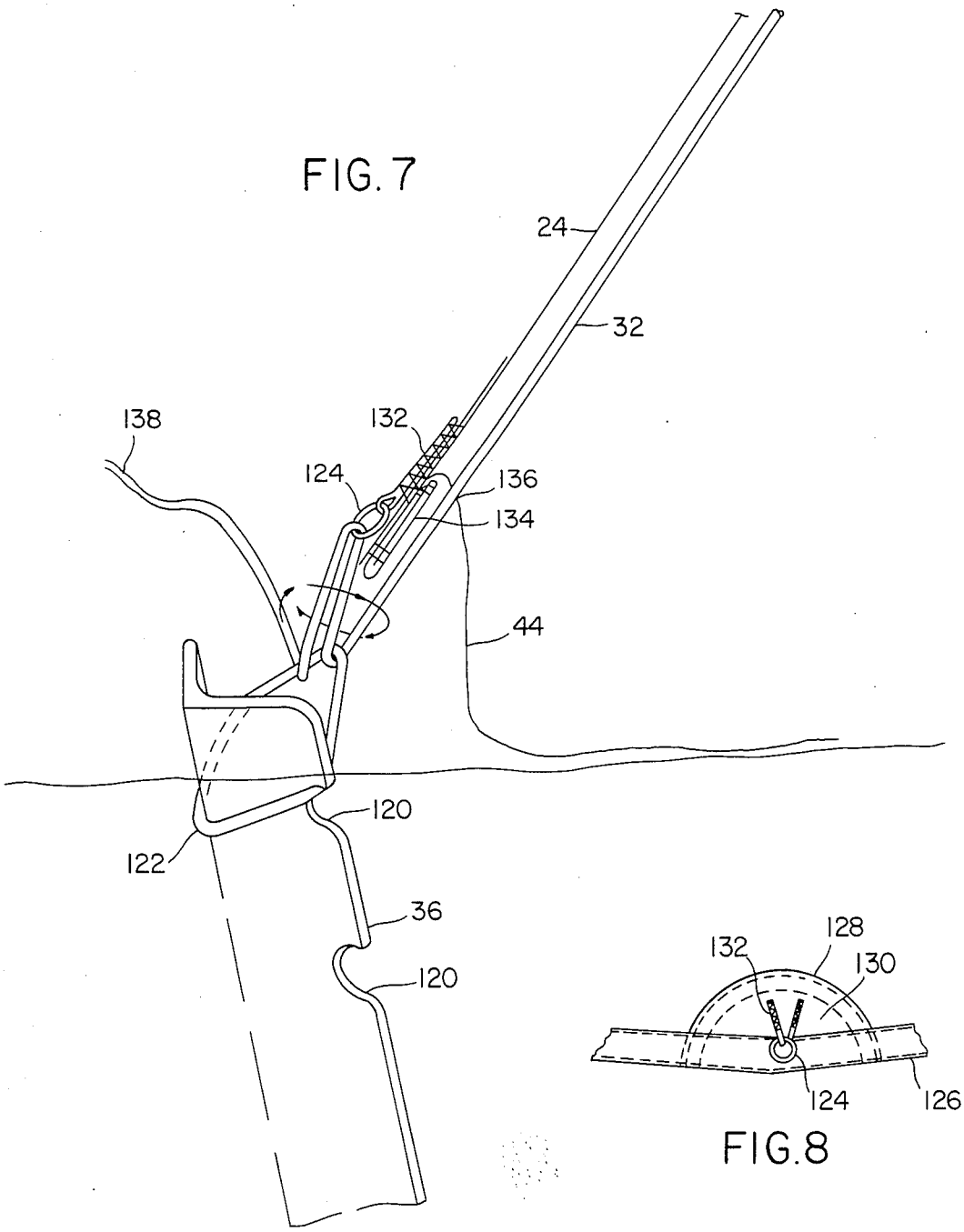
FIG. 7 is a perspective view of a stake and parts of a tent secured thereby.
FIG. 8 is a front view of a hem of a tepee wall.

Another unique and important feature of the lodge is the individually adjustable band tie-down system, as depicted in FIG. 7 and 8. The tie-down system is a principal feature of the lodge, its advantages including its simplicity, its adaptability for various terrains, the versatility allowed in arranging the tent wall, and the ease in which the tie-down system is operated. At the same time, the tie-down system is strong and durable and does not require any fancy, expensive and heavy hardware.

As noted above, skin 24 lies on and is supported by radiating bands 32. The bands and skin are connected together only at the top of the smoke-hole hem, and the bands are anchored to the ground by means of respective stakes. A single band 32 and stake 36 are depicted in detail in FIG. 7. A stake is made of a strong, lightweight material, such as aluminum, and is provided with pairs of notches 120 on either edge, one notch of each pair being depicted in FIG. 7. A two-inch diameter stake-band ring 122 is looped around and hooked onto one pair of notches. Suitable materials for the stake-band ring include stainless steel wire or polyester solid cord.

As mentioned hereinabove, skin 24 is provided with stainless steel tie-down rings 124, each disposed along bottom hemline 126 of the skin. A semi-circular reinforcement hem 128, serving to affix reinforcement piece 130, is disposed about each tie-down ring, and a V-shaped support attachment 132 extends from an area adjacent to reinforcement hem 128, and loops around respective ring 124. As best depicted in FIG. 7, ground skirt 44 is stitched into bottom hem 134 of wall 24. A slot 136 is provided for each band 32, said respective band passing through slot 136.

In order to secure radiating band 32 to a respective stake 36, free end 138 of the band is inserted through the stake-band ring 122, and then looped back up and inserted through tie-down ring 124. Then, the band is brought back down and again looped through the stake-band ring 122 and wrapped around and tied off, as indicated by the arrows in FIG. 7. A simple half-hitch knot is then used to hold the band firmly in place and allow it to be untied easily. In one embodiment, free end 138 of each band is a separate section of filled, round and firm 500-pound test nylon parachute cord, about 32 inches in length, and is tied to a respective band after the band passes through slot 136, such that end 138 is composed of a material especially adapted for tying and can be easily replaced.

Normally, stake-band ring 122 is left tied onto a respective band 32 when the tent is disassembled and not left on the stake, so that the tent can be erected quickly and conveniently. To set up a tent that has been stored in this fashion, the stakes are driven into the ground first and then the lodge fabric is laid out and the stake-band rings are looped over the stakes. Then, center pole 14 is inserted through door 16, the pole being secured to an apex ring 34 and then raised.

Tension on the bands and skin 24 is applied by jacking up center pole 14 so that the skin is smooth and taut. However, when encountering uneven, rolling ground, tension on individual bands and respective areas of skin will be uneven. The tie-down system of the present invention allows for each band's tension to be adjusted individually and thus assures equal tension on all of the bands, and at the same time assures equal tension on all there is of the skin so that it is smooth and unwrinkled. Further, the system permits the tension on the bands and skin to be drawn separately or simultaneously. Even when there is a sizeable rut or dip in the ground, the bands may be lengthened considerably to compensate and will still maintain equal tension on all of the bands and all areas of the skin. If by chance a band end 138 is not long enough, a piece of cord is simply added. In this way, the system permits the lodge to be set up in a rugged, mountainous country or to be pitched quickly for a temporary camp, for example, to weather a sudden storm, without the need for laboriously preparing or levelling the ground.

There are many occasions when one would need or desire to open up the lodge by raising up skin 24, for ventilation on a hot day or just enjoy the view, and to be able to do this without weakening the supporting structure, as well as to be able to close up the lodge quicly and easily in case of sudden bad weather. To this end, the tie-down system is particularly well adapted. In order to raise the bottom of skin 24, a number of bands 32 are untied and pulled to through skin tie-down ring 124 and retied, under appropriate tension, to band-stake ring 122 itself. This will maintain structural support strength in case of winds and also will provide the necessary support for the raised skin. When only a protion of the skin is to be raised, the untying and retying of perhaps 12 bands 32 is sufficient. All of the bands can be untied and retied and the entire bottom of the skin raised to have the effect of a large beach umbrella. Tie cords 140, are used to hold up the raised skin. As depicted in FIG. 2, they are disposed about an annular outer surface of wall 24, about halfway up.

Figure 9:
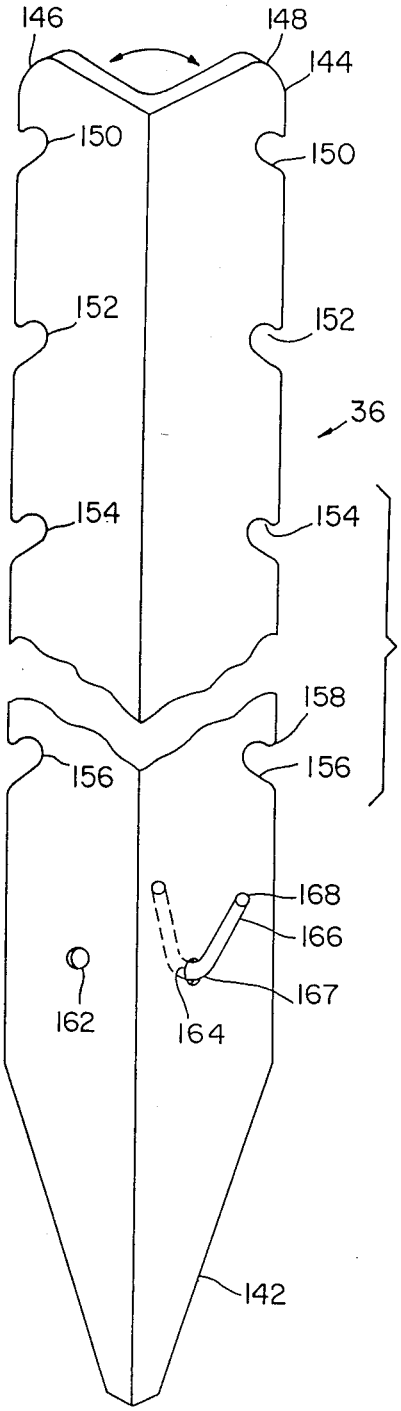
FIG. 9 is a front perspective view.
Figure 10:
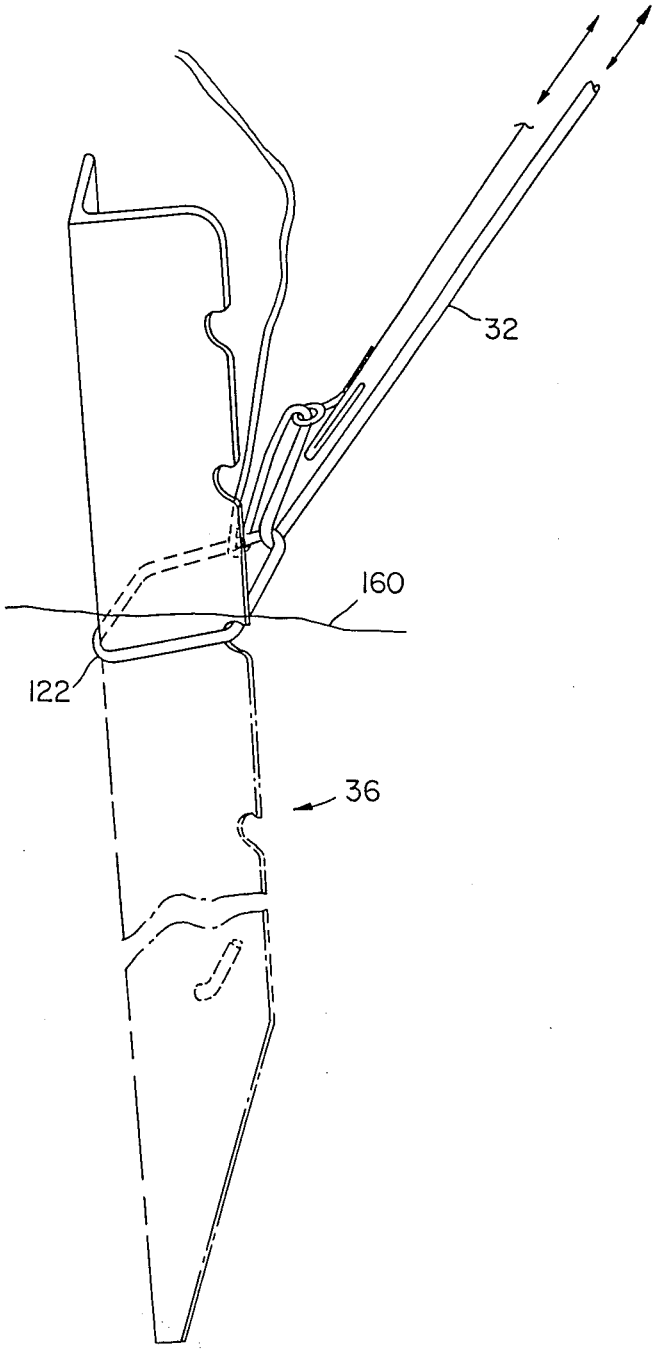
FIG. 10 is a side perspective view of a stake.

The stake of the present invention is of major importance, as the effectiveness of the lodge against high winds is dependent directly upon the holding efficiency of the stakes. In accordance with the present invention, a simple yet novel design allows an efficient, lightweight, compactible, strong, versatile and all-around general purpose stake. The variable-depth lodge stake 36 is depicted in detail in FIGS. 9 and 10. The stake is preferably made from standard 90-degree hard aluminum stock, about 5/32 of an inch thick. The 90-degree angle allows the stake to present a wide, angled surface to the soil so that it offers good resistance to the oblique pole from a respective radiating band. Depending on the size lodge involved and on average soil conditions most likely expected, the stake can be made in different widths, from about 1 to 2 inches, and in different lengths, from about 14 to 24 inches. For a 16 to 20 foot diameter lodge, for example, a general purpose size stake would be 1½ inches wide and 18 inches long.

At end 142, the stake has a long, tapered point for ease of driving into the ground. At the other end 144, corners 146, 148 are rounded off to prevent less of a hazard in case one should happen to fall on the stake. An essential feature of stake 36 is the provision of pairs of notches 150, 152, 154, 156, spaced at varying increments from the top of the stake. Each one of a pair of notches is disposed on a side opposite from the other notch of the pair, each on a respective outer edge of the stake. In a preferred embodiment, each notch is ⅜ by ⅜ inches and is cut so as to form a slight hook 158. The edges of the notch are rounded and made smooth so as not to be sharp or abrasive. In the depicted embodiment, a series of four notches is formed along both sides, each pair of notches being spaced two inches apart, with the last pair extending down 8 inches from the top of the stake.

As has been stated above, the purpose of the notches is to provide a means of attachment for radiating bands 32, whereby a stake-band ring 122 loops around the stake and hooks into a pair of notches. The series of pair of notches allows the stake to be driven into the ground to varying depths, depending on different hardnesses of soils encountered, without affecting the holding power of the stake. When the ground encountered is soft, the stake is driven in all the way, leaving about three inches of the stake above ground, and when the ground is hard-packed, it need only be driven in, for example, halfway. In this way, there is always a pair of notches close to ground level 160 for hooking a respective stake-band ring onto. This results in the tension force-line of the stake-band ring always acting at a point on the stake at ground level i.e., near the fulcrum point of the stake, resulting in a short lever arm being applied to the stake. A long lever arm would cause the stake to be pulled out much more easily. It is noted that each inserted stake is preferably angled outwardly about 18 to 20 degrees.

Another useful purpose for the notches formed in stake 36 is that of providing a means to hook a tool into, to conveniently pull the stake out. For example, a rope made into about a 3-foot loop and hooked around a pair of notches is suitably used to pull a stake out. Alternatively, the hammerhead of a flat hatchet is suitably used to drive the stakes in, while the blade of the hatchet is suitably hooked into the notches to pull the stakes out after tapping the sides of the stakes to loosen them.

An additional innovative feature of the stake of this invention is the two holes 162, 164 drilled into the approximate center of each side of the stake. In the depicted embodiment, the holes are drilled about 5½ inches up from the bottom of the stake, below the bottommost pair of notches 156. V-shaped hook 166 is inserted when additional anchoring power is required, center 167 of the hook being retained in the hole. Hook 166 swivels freely so that point 168 of the hook goes into the ground easily but resists movement in the reverse direction. Either one or two hooks may be used on each stake.

They can be removed easily, allowing several stakes to be compactly stacked together, one inside the other. The ability to be stacked compactly for transport is another advantageous feature of the stakes.

The stakes can be driven into just about every type of ground, except solid rock. When encountering frozen, very hard-packed or rocky soil, a mason's hand star-drill is effectively used to make a pilot hole. This eliminates the need for beating the stake, allowing the stake to last longer.

Still another important and unique feature of the present lodge is the stake-marking compass that is used to lay out the stakes of the lodge. The compass is a simple, easy-to-use device that offers the necessary accuracy in locating the stake positions and yet permits the desired speed in setting up the lodge. Compass 170 is depicted in FIGS. 11 and 12.

Figure 11:
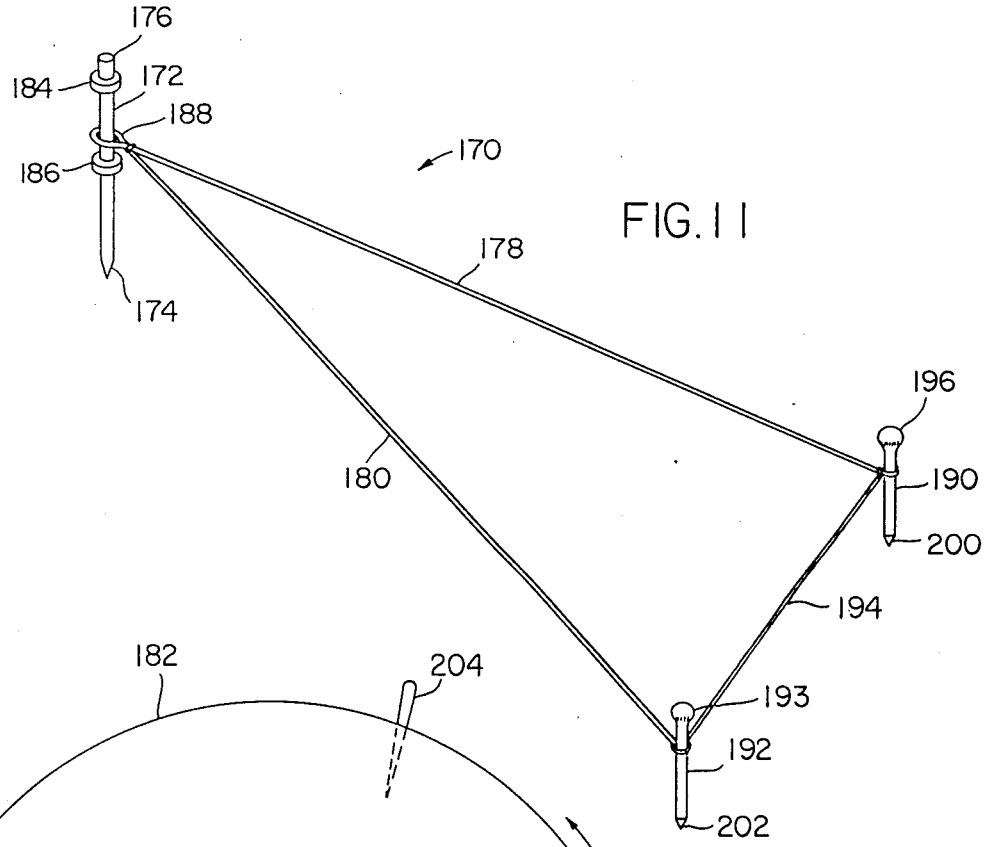
FIG. 11 is a perspective view.
Figure 12:
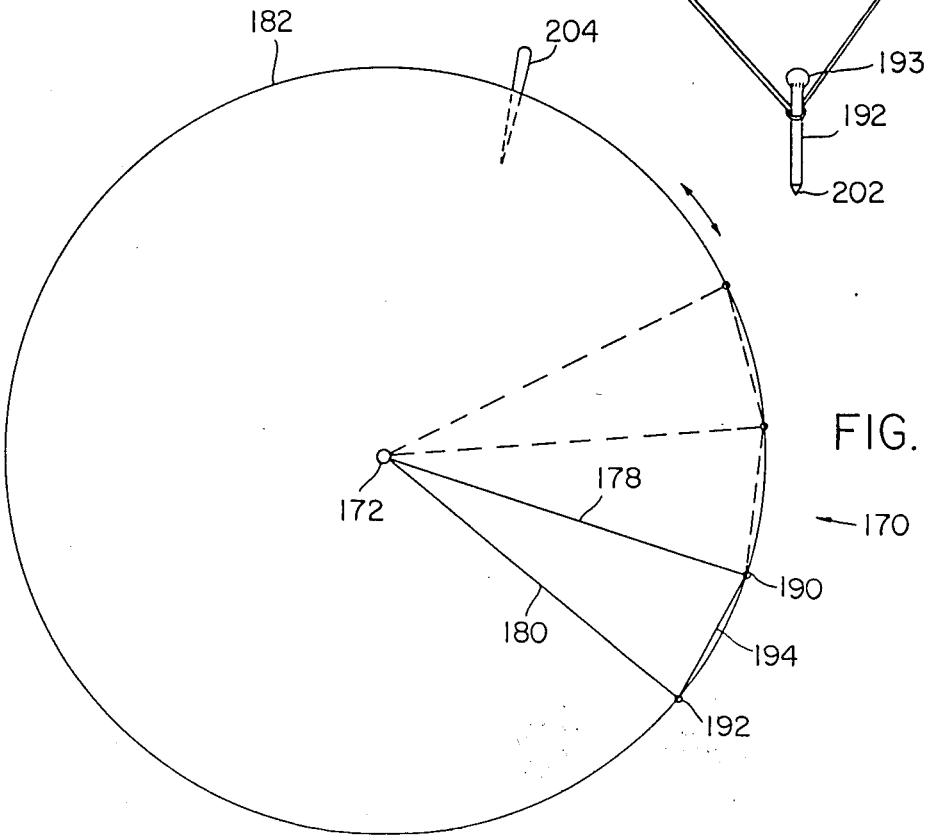
FIG. 12 is a plan view of a stake-marking compass.

As best depicted in FIG. 11, compass 170 includes center stick 172, which is driven into the ground to position the center of the lodge. In the depicted embodiment, center stick 172 has a ¾ inch diameter and is 18 inches in length. End 174 of the center stick is pointed for easy insertion into the ground, while end 176 is flattened to facilitate pounding with a hatchet or other tool. Two radius cords 178, 180 are rotatably affixed to center stick 172, being looped loosely around the center stick so that they can swivel freely. The cords are non-elastic, and in the depicted embodiment, are ⅜ inches thick. The radius cords radiate from the center stick a distance equal to the length of the radius of the circular perimeter 182 about which the stakes are to be positioned. Perimeter 182 is somewhat larger than the diameter of the base of skin 24. For a lodge having a diameter of 20 feet, the length of radius cords 178, 180 is 10 feet, 4½ inches, in order to account for the fact that the base of skin 24 is an inch or two off the ground, and further to account for the tensioning of skin 24 about its base.

Also disposed on center stick 172 are two pressure-fitted rubber rings 184, 186 which can be slid up or down center stick 172 as needed to elevate radius cords 178, 180 above grass or any other low obstacle to thus permit the free, unobstructed rotation of the radius cords. As can be appreciated in FIG. 11, rubber rings 184, 186 prevent loop 188 of the radius cords from passing above or below the rings. Determined by the firmness of the soil, center stick 172 protrudes above ground as much as possible and needs only to be driven into the ground far enough to offer firm resistance when tension is applied to the radius cords. Of course, any high bushes or relatively large obstructions must be cleared away.

At the distal end of each radius cord is attached a peg 190, 192 and a third non-elastic cord 194, which is as long as the desired separation between each of the lodge stakes about the perimeter of the lodge, is affixed between the two pegs. Thus, a triangle is defined by cords 178, 180 and 194. In the depicted embodiment, pegs 190, 192 are ½ inch in diameter and 8 inches long, and have enlarged rounds knobs 196, 198 at their upper ends. The knobbed ends are designed to fit comfortably into the palms of the hands for a convenient grasp and to enable the pegs to be easily pushed downward, poking a hole into the ground. Bottom ends 200, 202 are sharpened, also to facilitate making the necessary hole.

In using marking compass 170, pegs 190, 192 are grasped by their knobbed ends, one in each hand, such that simultaneously a light, equal tension is applied on both radius cords 178, 180 as well as on stake separtion cord 194. It is important to apply light, consistent tension on these cords and also to hold both pegs vertically. Depending upon whether one desires to mark the stake positions by moving around perimeter 182 clockwise or counter-clockwise, one of pegs 190, 192 becomes the anchor peg, while the other peg becomes the stake-hole-marking poker peg. In the embodiment depicted in FIG. 12, peg 190 is the anchor peg and peg 192 is the poker peg.

The method of using the compass is best illustrated by reference to FIG. 12. To begin, the anchor peg is first stuck into the ground, starting at a point that will designate the left edge of the door. At this position, the lodge door stake will be implanted. After the anchor peg is stuck in the ground in this fashion then, holding tension on the three triangular cords, a noticeable hole is poked into the ground with the poker peg. Next, placing the anchor peg into the hole just made with the poker peg, and again applying equal and consistent tension on each of the cords, a third hole is poked into the ground with the poker peg where the next stake will be located. Then again, the anchor peg is put intoot this most recently made hole and the process is repeated all the way around the lodge perimeter until all of the stake locations have been marked. In the depicted embodiment, the lodge has a diameter of 20 feet and uses 28 stakes, each of the stakes being separated from adjacent stakes by 28 inches. More stakes may be needed in windy conditions or when the ground does not firmly hold the stakes.

In FIG. 12, six stake positions have been located in this fashion, moving in a clockwise direction. One stake, lodge door stake 104, has already been implanted at its designated position. The dotted lines indicate two previous positions of the compass. In the position indicated by solid lines, anchor peg 190 has been inserted into a hole just made by poker peg 192 and poker peg 192 has been moved forward, and while equal and consistent tension has been applied to cords 178, 180 and 194, poker peg 192 has poker a hole at its present position.

Each hole poked in the ground should be noticeable and easy to locate again. Sometimes this is difficult where there is thick, matted grass, so as small patch must be cleared away. In a preferred embodiment, a stake is placed immediately in each hole as one works one's way around perimeter 182. Most optimally, a second person follows behind the person operating the compass, the second person driving the stakes partly into the ground. The stakes are then driven in sufficiently firmly all around, after which the lodge's band-stake rings 122, depicted in FIG. 7, are attached to respective stakes. Then, center pole 14 is inserted through the door opening and affixed to apex ring 34, cap 18 is affixed by eye-screw 96, and pole 14 is then erected at the center of the lodge, causing skin 24 also to be erected. Because the stakes are all driven in first and then the lodge attached before raising it, this method permits the lodge to be erected even during a windstorm, a very unique and important feature of the present invention. This method of locating the tent stakes is also consistently accurate and very fast, taking one person approximately ten minutes to accomplish.

Figure 13:
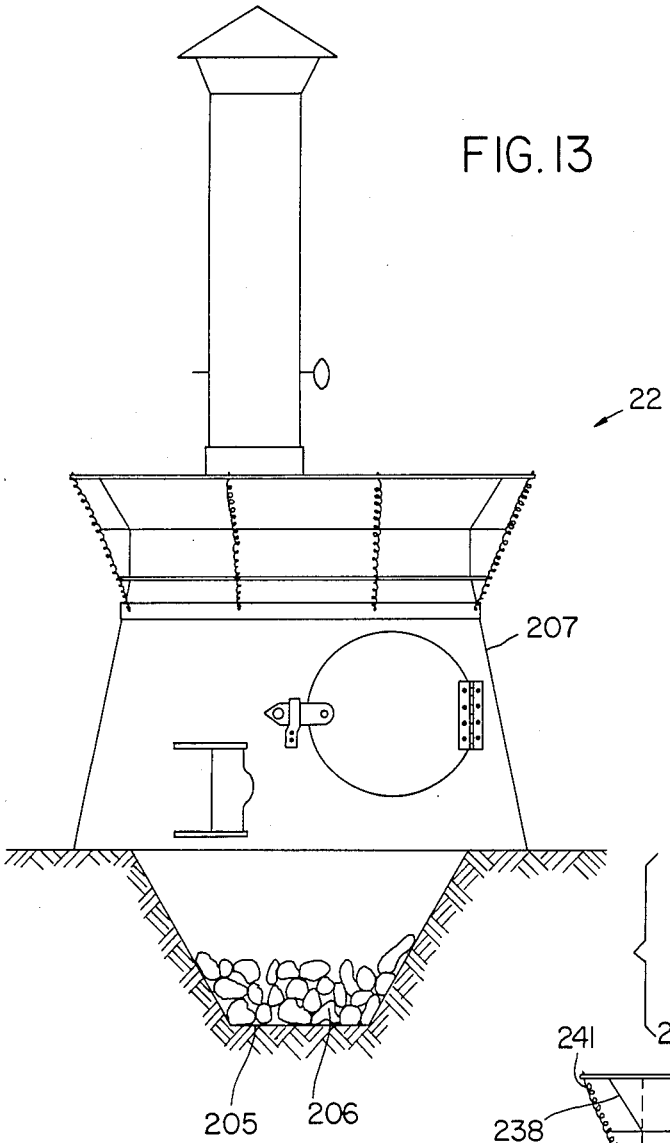
FIG. 13 is a perspective view of a stove.

A final novel and important feature of the present invention is the portable lodge camp stove, a preferred embodiment of which is depicted in perspective in FIG. 13. The design of stove 22 offers many features and advantages not found in any other camp stove. The stove is air-tight, efficient, light-weight, compactible, portable, versatile and aesthetically pleasing. The stove allows the most optimum heat efficiency per unit of fuel and eliminates inefficient, smokey fires. The stove is needed for many situations, but more so for permanent or semi-permanent camp living, especially for winter and arctic camps, work camps, expedition base camps, etc.

The inventive concepts of the stove are suitably employed in several different models, sizes and weights to best suit different requirements or purposes, such as for very light-weight travel, for different volume shelters to be heated, or for the number of people to cook for, etc. A miniature size is made for backpacking which has the advantage over a gas stove in that heavy, dangerous fuel need not be carried and the advantage that more heat is provided. A relatively large embodiment of the stove is adapted for use in a cabin or house. The stove is also suitable for use anywhere outside, such as in picnic areas or public campgrounds, where it is much more efficient, safe and resistant to the elements than an open fire.

One significant inventive feature of stove 22 is the absence of a bottom. This feature allows the stove to be lighter and also permits utilization of the earth. In using the ground as the bottom, the fire is placed at the lowest elevation, aiding in the prevention of a cold air layer forming on the floor of the lodge. This cold air layer phenomenen is completely prevented by drawing the combustion air from the exterior of the lodge along with sealing the bottom periphery of the lodge.

The elimination of a bottom also allows the fire to heat the ground to make it warmer and drier and to store heat for late evening release. To increase this advantage, especially in winter and more permanent camps, a ground-pit 205 is dug. This ability to use a ground-pit affords additional advantages, including the enlarging of the combustion chamber's capacity, the extending of the expected life of the stove's metal, and the maintaining of a hot water supply for frequency dipping out without taking up space on the cooking surface.

Other of the major inventive features of the stove include the compound spiral flue chambers and the ability of the stove to be disassembled and made compact for transport. These and other advantageous aspects, including the operation and use of the stove, are further described hereinbelow in connection with the drawings.

Figure 14:
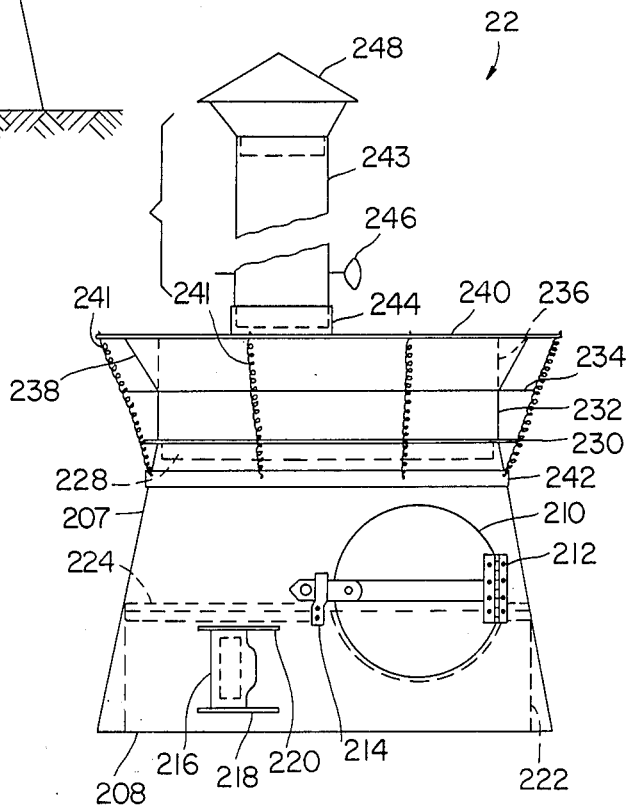
FIG. 14 is a front view of the stove of FIG. 13, with some parts shown in phantom.

FIG. 14 illustrates stove 22 with certain of the parts being depicted in phantom. The stove consists of a partial, conical main body 207, having an open bottom 208. Wood feeder door 210 is disposed in the main body and is provided with hinge 212 and latch 214. Primary air inlet sliding door 216 is also provided in main body 207 and slides on guide rails 218, 220. In phantom, primary air preheater channel rim 222 is depicted, as well as optional preheater channel rim retainer rim 224.

Main body key rim 228, depicted in phantom in FIG. 14, keys into the top of main body 207. Above rim 228 is bottom plate 230, lower gas-containing rim 232, which contains compound spiral flue chambers, middle plate 234, and upper gas-containing rim 236, shown in phantom, which also contains compound spiral flue chambers. Secondary air preheater channel 238 is disposed about rim 236, and top plate 240 is disposed above rim 236. Springs 241 attach at one end to top plate 240 and at another end to main body reinforcement rim and spring catch 242.

Stove pipe 243 is connected to the remainder of the stove with stove pipe joining phlange 244. The stove pipe is also provided with butterfly draft control 246 and stove pipe cap 248.

In the depicted embodiment, main body 207 is $14\frac{1}{2}$ inches tall, has a diameter of 18 inches at its top, and has a diameter of 24 inches at its bottom. Door 210 is 3/32 inches thick, has a diameter of $9\frac{1}{2}$, inches and covers a hole 8 inches in diameter. Primary air preheater channel rim 222 is 5 7/8 inches in height and is made of metal 1/16 inches thick.

Bottom plate 230 has a diameter of $19\frac{1}{2}$ inches and is 3/32 inches thick. Middle plate 234 is $21\frac{3}{8}$ inches in diameter and 1/16 inches thick. Top plate 240 is $24\frac{3}{4}$ inches in diameter and $\frac{1}{8}$ inches thick. Rims 232 and 236 are each $2\frac{1}{2}$ inches from top to bottom. Preheater channel rim 238 is composed of a material 1/16 inches thick, and top plate 240 measures $20\frac{1}{4}$ inches from the ground.

Stove pipe 243 is 5 inches in diameter and 6 feet tall. Pit 205 is 9 inches deep, 18 inches in diameter at its top, and 8 inches in diameter at its bottom. Stones 206 are approximately 3 inches deep, such that the distance from bottom plate 230 to the top of the stones is approximately 20 inches.

Main body 207 forms the sidewalls of the primary combustion chamber. As depicted in FIG. 15, it has a partial conical cylindrical shape, offering stability and permitting all of the stove's pieces to be compactly stowed away inside for convenient transport, as will be described hereinafter. It is composed of approximately 1/16 inches thick flat, sheet steel.

Several reinforcements are made to aid in the prevention of heat warping. First, there is reinforcement rim 242 that is welded to the main body just above door 210. In the depicted embodiment, rim 242 is 1 inch wide, 3/32 inches thick and $2\frac{1}{4}$ inches down from the top edge of main body 207. Rim 242 is also used to hook the springs connecting the upper plate to the main body and has equally spaced apart holes 250 into which the springs are hooked. In the depicted embodiment, there are six holes having diameters of 3/32 inches. Second, there is rim 228 that sits on top of main body 207 to form, with plate 230, the ceiling. In the depicted embodiment, the rim is welded to the undersurface of the plate, the rim being 1 inch wide and 3/32 inches thick. The rim is 18 inches in diameter, the same diameter as the top opening of main body 207. The rim keys into the main body opening, fitting snugly and thereby holding the round shape of the main body. Reinforcement rim 224 is also provided in a preferred embodiment. It is, in the depicted embodiment, 1 inch wide and welded to the main body and supports preheater channel rim 222. Reinforcement rim 224 is continuous about an annular inner surface of body 207, except where the surface intersects with door 210. Other means for protecting the main body from heat warp are described below.

The main body sits directly on the ground and has no bottom. To achieve air tightness in the primary combustion chamber, dirt is backfilled and slightly packed down, about 3 inches up all around the base.

The fire chamber defined in this fashion will accommodate logs up to 18 inches long and 4 inches thick. Logs of an ideal size for easy handling in the depicted embodiment would be 12 inches in length, and a maximum size would be 20 inches long and 6 inches thick.

Opening 252 that is covered by door 210 is provided for the insertion of firewood. The raw edge of this cutout is curled in order to help keep its shape. Door 252 covers and closes this hole and is hinged to one side, as stated over. The hinge is slightly out of plum so the door will stay in the open position until closed manually. Around the inside edge of the door is an insulating fiber strip to seal the door and make it airtight. A swivel latch locking handle 254 is mounted on door 210 at the end of reinforcement strap 225, and locks with a friction pressure to catch 256, which is mounted on the main body. The reinforcement strap, in the depicted embodiment, is 1 inch wide and welded to door 210.

There is also a primary combustion air-intake hole 258 with a sliding volume-control door 216 on the side of the main body, just to the left of wood-feeder door 210. Additional combustion air can be obtained by cracking open door 210, especially when first starting the fire, and until a sufficient draft is obtained. In the depicted embodiment, air-intake hole 258 is 1½ inches by 3½ inches.

Ground fire-pit 205 is provided in one embodiment to enlarge the primary combustion chamber's capacity and also to put the fire into the ground, so that the earth walls of the pit take the brunt of the heat, rather than the metal of main body 207, thus helping to conserve the metal from heat fatigue. This is especially advantageous on long winter camps when intense fires are burned for long periods, and also keeps the ground warmer and drier.

As noted above, the bottom of pit 205 is filled in one embodiment with about three inches of rocks 206. If the nature of a particular soil type causes pit 205 not to hold its shape, the side walls are lined with rocks, and in this case the pit is dug a little wider and dirt is packed down around the top edge, so that the base of the stove sits firmly without air leakage. To ensure that the stove's bottom sits firmly and evenly on loose soil, flat rocks are placed underneath as necessary.

The primary combustion air intake is in one embodiment from primary air inlet hole 258 cut into the side of main body 207 near its base. As discussed above, the hole is covered with a sliding door to control the volume of air. Heating the incoming cold, oxygenated fresh air is of prime importance to achieving and maintaining an efficient combustion temperature for a complete and clean burn. To accomplish this, an air preheater channel is formed by inserting into the inside of the main body primary air preheater channel rim 222, as depicted in FIG. 14. In the illustrated embodiment, rim 222 is 5⅞ inches high, and the bottom edge is 1⅜ inches from the main body's wall, all around. The top edge of rim 222 fits snugly against the main body's angled wall, thus forming a completed annular channel 262, as depicted in FIG. 16. Also depicted in FIG. 16 are the air intake hole 258, air intake control door 216, and wood feeder door 210. The flow about channel 262 is blocked by a triangular piece of sheet metal 264 which is disposed just to the right side of air intake hole 258. In this fashion, incoming air is caused to circulate in only one direction, clockwise around the channel, according to the correalus force. As the cold air circulates in this fashion in contact with the metal of channel rim 222, as well as main body 207, a sufficient distance is transversed so that the circulating air temperature is raised quite high before its introduction into the combustion chamber, thereby assuring the maintenance of high combustion temperatures, even on the coldest days.

The introduction of the heated air into combustion chamber 265 occurs mainly at the wood-feeder door 210, where channel rim 222 is provided with cut-out 266 to accommodate the door's opening. Since door 210 is disposed just to the left of sheet metal block 264, this arrangement requires the incoming air to travel the greatest distance through channel 262. In addition, some strategically placed holes 268, 270 are placed on channel rim 222 in order to achieve a wider distribution of the oxygenated air. Rim 222 takes the brunt of the heat and is much easier to replace, when required, than main body 207. In this way, the metal of the main body is conserved. To help prevent channel rim 222 from bulging or warping and prematurely releasing its air into the fire, retainer and reinforcement rim 224 is welded to the inside of the main body, where channel rim 222 contacts the wall of main body 207. Rim 224 is suitably 1 inch wide.

The compound sprial flue chambers are depicted in greater detail in FIGS. 18 to 21. Two layered, circular, substantially horizontally disposed flue chambers sit one on top of the other and on top of main body 207, as depicted in FIG. 14. The chambers are formed by three plates 230, 234 and 240 and two gas-containing rims, 232, 236 stacked on top of one another with plate 230 being the ceiling for primary combustion chamber 265 and plate 240 forming the cooking surface. The plates and rims are attached to main body 207 under pressure by springs 241 which are equally spaced and hooked to top plate 240 and to reinforcement rim 242. The firm pressure of the springs closes any gaps in the joints between the plates and rims, assuring a tight seal. The gas-containing rims and rim 228 are spot-welded to the undersides of the plates to maintain their centered positions. Thus, as depicted in FIG. 18, annular rim 228 is spot-welded to the bottom of plate 230, which is provided with hole 272. As depicted in FIG. 19, lower rim 232 is spot-welded to the bottom of middle plate 234. As depicted in FIG. 20, upper rim 236 is spot-welded to the bottom of top plate 240. Opening 274 is provided in plate 234. Opening 276 and work hole 288 are provided in plate 240. Springs 241 serve not only to connect the compound flue chambers to main body 207 but also to keep middle plate 234 centered as well. Holes 286 are provided in an outer edge of rim 230 and are used to hook springs 241 into for compacting and transport.

In use, hot wood gases from the primary combustion chamber rise up through the series of holes cut into the plates. In the depicted embodiment, the holes are 5 inches in diameter. The gas spirals twice clockwise, with the assistance of the correalus force, in the flue chambers, and is guided by baffles 278, 280, which are spot-welded to the bottom of middle plate 234, and baffles 282, 284, which are spot-welded to the bottom of top plate 240. Baffles 278, 280, 282 and 284 have a depth of 2½ inches in the depicted embodiment. Opening 272 of rim 230 is depicted in FIG. 19 to indicate the origin of the gases circulating within rim 232, and opening 274 of plate 234 is indicated in FIG. 20 to indicate the origin of the gases that circulate within rim 236. After the gases circulate, as indicated by the arrows in FIGS. 19, 20 and 21, they exit to the smoke-stack through hole 276.

The layered flue chambers cause the heat of the primary combustion chamber to heat the spriralling gases, maintaining their high temperatures with the lower flue chamber continuing to heat the chamber above. The addition of other layered flue chambers is within the scope of the invention. The flue chambers enable the retension of the gases long enough for a complete burn of the gas to take place, and also permit time for the extraction of the heat.

Since there is a tendency for the rising, spiralling gases to take the shortest path possible on their trip up and around the chambers generally defined by rims 232 and 236, the baffles are used to guide the gases into the longest indirect path possible to thereby retain the heated gases for a longer period of time. It is within the scope of the present invention to align these baffles differently and/or to add additional baffles for optimum effect in directing the gases into the longest path possible.

The secondary combustion air and preheater channel 288 is depicted in more detail in FIGS. 22 through 24. To assist in the complete burn of the gases, preheated secondary air is introduced from this channel into the second level flue chamber. This is accomplished by adding secondary air preheater channel rim 238 to upper gas-containing rim 236. The additional flat sheet metal rim, in the depicted embodiment, has a 60 degree angle to it, so that circular channel 288 is formed. Hole 290 is strategically cut into this angled rim through which oxygenated fresh air enters the channel. Sliding door 292 disposed over this hole controls the volume of air allowed to enter. Channel 238 is blocked off by sheet metal block 294 at a point to one side of hole 290, causing the air to move in only one direction around channel 288.

Interior gas-containing rim 236 is also provided with a hole 296, in order to introduce the fresh, preheated air into the flue chambers' spiralling hot gases to thus result in secondary combustion of any gases not yet combusted. Hole 296 is made at a point where the rising gas enters the flue chamber from hole 274 in middle plate 234. The long path around preheater channel 288 allows the cold air entering to be heated by the metal rims to temperatures near the requirement for combustion to occur, resulting in the least cooling of the spiralling gases in the flue chamber.

The smoke-stack assembly is depicted in greater detail in FIGS. 25 through 27. Stove-pipe 243 in the depicted embodiment is made of a 5-inch diameter standard-size flue pipe that fits onto phlange 244, which is in turn mounted in top plate 240. The stove pipe is secured by sheet metal screws 298. The length of pipe 243 varies according to different requirements, and in case of use with a 20-foot diameter lodge, it is preferably 6 feet in length so that, in addition to the 20-inch high stove, it reaches a height of 7 feet, 8 inches. This is high enough so that the top of the stack protrudes safely beyond the height of the lodge's liner ceiling 42, yet remains at least 3½ to 4 feet from any point of the lodge's outer skin 24. The stack assembly should be nearly centered under lodge smoke-hole 30, sufficiently so as to eliminate any fire hazard. In particular, the conically shaped lodge has been designed so that the smoke-stack does not protrude outside the skin 24, where, not only would a leakable hole be required, but the stack would be exposed to and buffeted by winds. In strong winds this could be quite hazardous, as the lodge's fabric, its primary support, would be fluttering about, shaking the stack. Also, the wind would affect the stack's draft.

An additional safety feature and one which is necessary to assure an adequate safety margin is the stove pipe's cap 248. The cap as designed disperses the rising, narrow column of hot air formed by the long straight pipe. The cap also acts as a spark-disintigrator to break up any large sparks that might otherwise escape. However, given the compound spiral flue through which any spark must travel, it is noted that the escape of sparks is not a likely possibility, especially when the stove is used prudently. By the time the hot gases reach the cap, they are cooled down considerably, the stove having extracted much of the heat.

There are some tents and applications where it would be necessary for the smoke-stack to protrude beyond the roof line, requiring the use of a specially insulated fabric flue collar. This would be according to the conventional manner of use of such collars and the necessary care would be required.

A short stove pipe, for example, a 6-foot pipe, need not have any other support, although it may be supported by a wire brace attached to the lodge's center pole 14 for assurance.

In the depicted embodiment, pipe 243 is composed of 1-foot sections 300, each connected to another by pairs of sheet metal screws 302. For compact, convenient transport, the six sections are disassembled and each section's joining seam 304 disconnected so that five of the sections stack together into one compact bundle. In one embodiment, the sections are carried in a water bucket wrapped in a cloth sack. One section 306 of the pipe is provided with standard butterfly valve draft control 246. In one embodiment, section 306 is adapted to be stowed, along with the cap, in the stove itself, and in a further embodiment the remainder of disjoint sections 300 are also stored in the stove.

Figure 28:
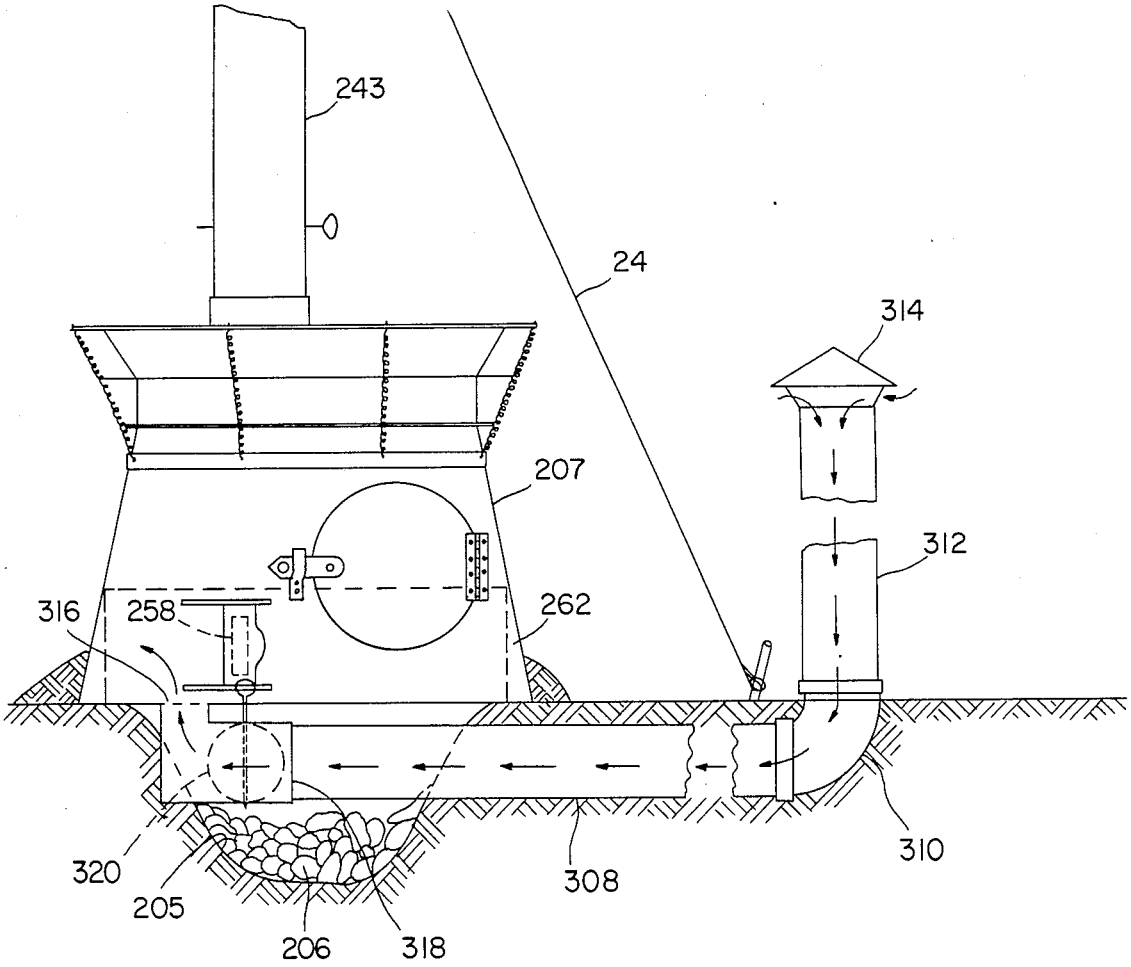
FIG. 28 is a side view of an exterior air intake pipe.

The means and manner in which exterior air is taken in from the environment in a preferred embodiment, is depicted in FIG. 28. In order to achieve a stable, warm atmosphere inside the lodge or tent, fresh air for the fire is drawn from its exterior, and by so doing, the forming on the ground of a cold air layer is prevented. To accomplish this, pipe 308 is laid under ground. In the depicted embodiment, the pipe has a diameter of 3 or 4 inches, and for a 20-foot diameter lodge, the pipe is 8 feet long in order to extend about 6 inches beyond lodge wall 24, at which point the pipe then protrudes up out of the ground by means of 90-degree elbow section 310. Vertical section 312 is provided with rain cap 314 on top to prevent rain and snow from entering. The portion of the pipe that is underground, as depicted in FIG. 28, is buried so that about 2 inches of dirt cover it, providing for a level floor.

The other end of pipe 308 enters primary air preheater channel 262 at a point 316 just to the left of the stove's primary air inlet 258. Specially made section 318 is used to connect the pipe to the stove. Section 318 is provided with butterfly-type air flow control valve 320 to permit adjustment of air intake. This specially made section is the only piece that must be manufactured for the system. Otherwise, just about any type of pipe will do. For example, at least a portion of the pipe can be composed of tin cans that are laid adjacent to one another in a trench or, where necessary, taped together, the elbow being formed by cutting out a vertical tin can to fit around a horizontal one. In an alternative embodiment, when necessary or desired for light travel, a pipe structure can be totally eliminated, whereby a trench is dug about 6 inches by 6 inches, and then straddled with a series of small, 8-inch wood sticks. A layer of grass and then a layer of dirt is supplied to seal the trench tunnel and make a level floor. The trench opening outside the lodge is protected from rain or snow by simply making a small tepee frame of sticks and covering it with a waterproof fabric.

Vertical section 312 protrudes out of the ground for about 3 feet in the depicted embodiment, in order to prevent the possibility of its being covered by snow. Of course, if the average snow-fall is less than 3 feet, this height is reduced accordingly. At any rate, if snow accumulates to a level above cap 314, it must be cleared away.

The cooking surface is depicted in FIG. 29. Top plate 240 provides a cooking surface sufficient to accommodate several large pots 322, 324, 326. The circulating hot gases of the flue chamber, just underneath top plate 240, heat fairly evenly an area 18 inches in diameter in the depicted embodiment, less the area occupied by stove-pipe joining phlange 244, sufficient to accommodate a 10-inch, 8-inch and 6-inch pot. The hottest spot, 328, depicted in FIG. 20, is where gases enter the flue chamber just to the right of the smoke-stack and where the secondary combustion gas is introduced. The outer edge of the cooking surface is the coolest. Regulation of cooking temperatures is accomplished both by the location of the pots and also by regulating the intensity of the fire itself.

As depicted in FIG. 20, a 7-inch hole cutout 288 with removable cover 330 is provided for a frying pan. This open hole permits heating directly with the spiralling hot gases. The top surface also may be used directly as a griddle. Additional space is provided in one embodiment by a disk 332, for example, one having a 7-inch diameter, that swivels out about pivot point 334 when needed and which is affixed by a swivel bolt and butterfly nut. It is conveniently used as a warmer plate and is removable for transport.

A grill adapted for use in the present invention is depicted in FIGS. 30 and 31. Grill 334 is added for barbequeing and roasting by removing plates 230, 234 and 240, and rims 232 and 236 by unhooking connecting springs 241. Grill 334 is then placed into the top opening of the main body.

The round wire mesh grill has two lifting handles 336, 338 that fold inward and lie flat for storage. The handles are made with a series of prongs 340 welded to them which are used to hook onto the uppermost edge of the stove, serving to support the grill and promote adjustment of its height above the coals, thereby contributing to the regulation of temperature.

In FIG. 32, roasting spit 342 is depicted. It is made by attaching two clips 344, 346 to opposite portions of the uppermost edge of main body 207. A spit 348 is inserted through clips 344, 346 and is provided with handle 350 for rotation.

Figure 33:
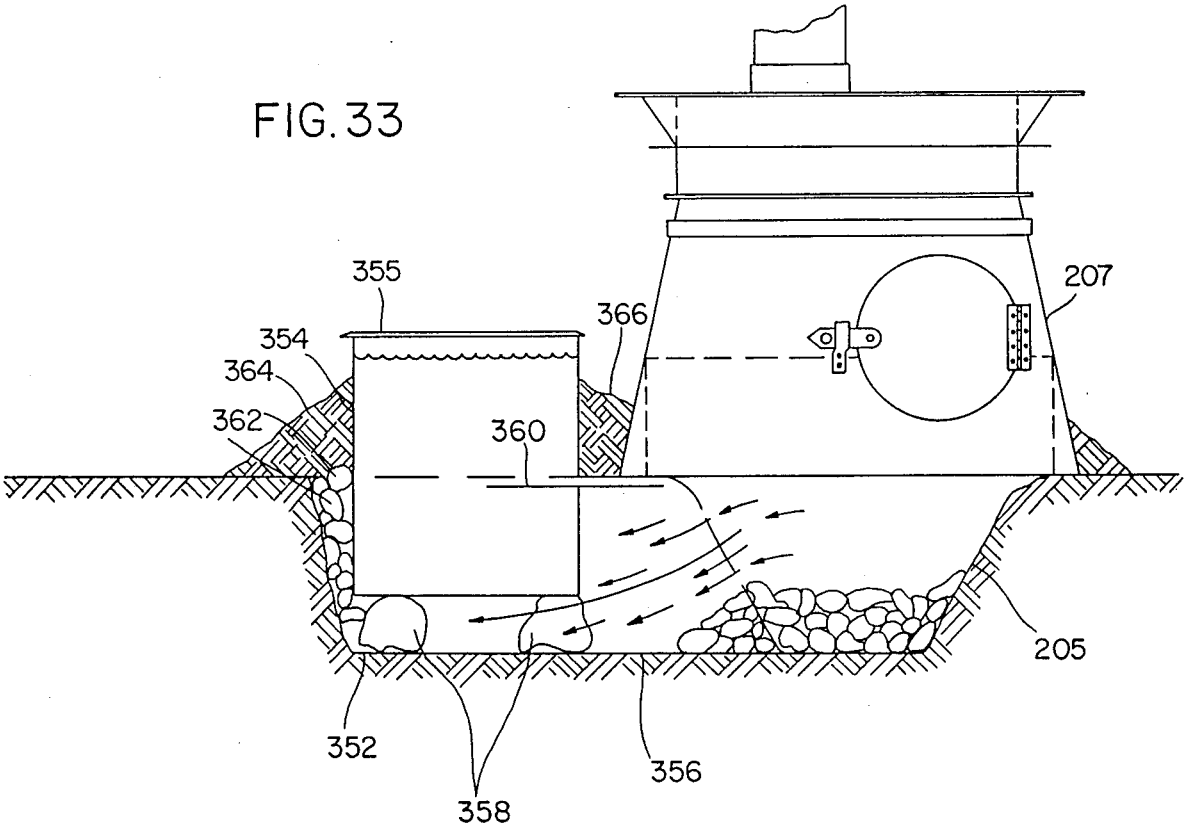
FIG. 33 is a front view of a hot water heating system.
Figure 34:
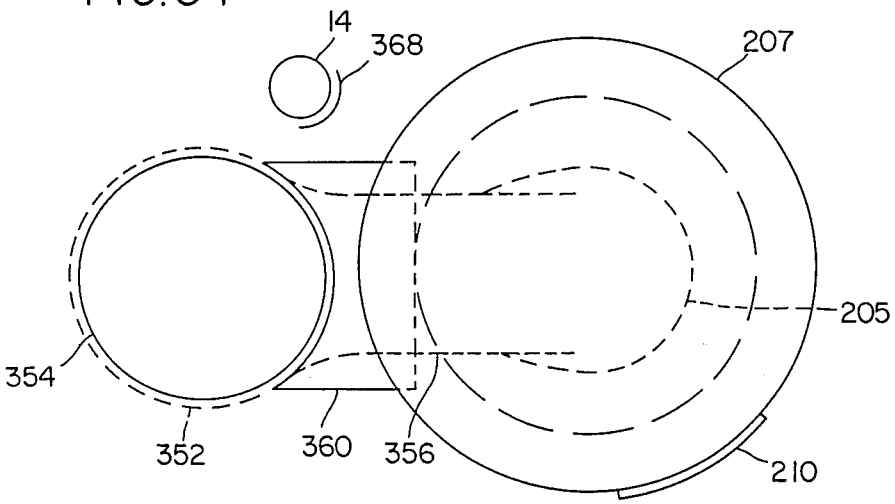
FIG. 34 is a plan view of the system of FIG. 33.

A hot water heating system is depicted in FIGS. 33 and 34. It is most convenient to have hot water available around a camp kitchen, and this system provides a simple yet effective hot water supply. As depicted in FIG. 33, another hole 352 is dug alongside fire-pit 205 in order to accommodate water bucket 354. In the depicted embodiment, bucket 354 is a 5-gallon metal bucket, approximately 12 inches in diameter and about 14 inches high, with cover 355. Bucket-pit 352 is made about 14 inches wide and about 9 inches deep, the same depth as fire-pit hole 205. An 8-inch trench 356 is then dug to connect the two pits. The water bucket is then placed in the bucket hole and sits on three or four rocks 358, the rocks having a height of about 3 inches. The rocks provide a space under the bucket through which hot air can flow. In the depicted embodiment, the bucket to stove clearance is 2 inches, and this clearance can be decreased towards zero in order to increase the warmth of the water. As depicted in FIG. 34, the stove is located about 6 inches away from center pole 14, and pole heat reflective shield 368 is placed therebetween.

Metal connecting cover-plate 360 is laid over trench 356, snug against bucket 354 with the stove sitting on top of it. Small rocks 362 are then placed around the edge of the bucket. Rocks 362 prevent dirt from falling down around the bucket when dirt 364, 366 is backfilled all around, over connecting cover-plate 360 and up the sides of the bucket to about 6 inches. The dirt is packed down a bit. The backfill covers all open cracks to achieve air tightness and also insulates the hot water bucket.

The fire and the hot coals in the stove's primary combustion chamber radiate heat through connecting tunnel 356 to the bucket walls and underneath the bucket to heat the hot water. A great amount of heat is stored in the rocks, dirt and hot water. The water stays hot for quite a while and helps warm the lodge long after the fire is out.

When intense fires are burned for long periods and to prevent the water from boiling away, a few more rocks are suitably placed in the tunnel entrance to deflect heat from the bucket. Hot water is dipped out when needed and the bucket is refilled from another container when necessary. The bucket is also used to stow away kitchen utensils and supplies during transportation.

The stove is very effective at extracting and releasing heat energy to the interior of the lodge. Main body 207, the compound flue chambers, as well as pipe 243 of the smoke-stack, i.e., all of the exposed metal surfaces, are used to radiate heat, as well as to conduct their heat to the surrounding air as the air flows over and around the stove's surfaces. Of special mention is the aesthetic and important feature of the compound flue chambers' plates 230, 234 and 240 which are adapted to increase the metal surfaces exposed by forming protruding, circular radiator fins. The heated ground is also a factor in the stove's ability to heat a lodge.

Plates 230, 234, 240 and rims 232, 236 are removed in one embodiment to offer a romantic fire light to a lodge while at the same time protecting the surrounding bedding, rugs, etc. from flying sparks, as well as preventing small children from accidentally contacting the fire. Of course, the entire stove can be removed easily, allowing the fire to be viewed directly, since the fire is already on the ground.

Figure 35:
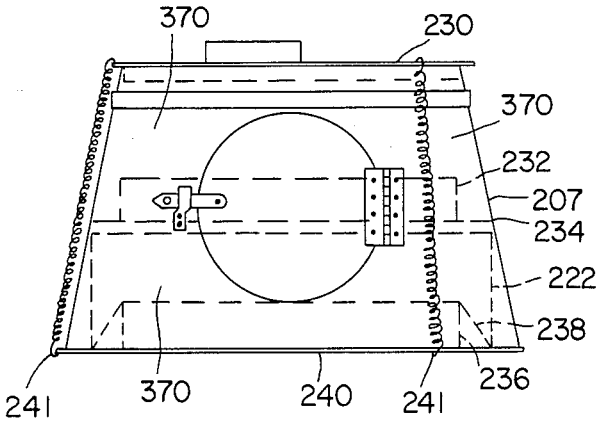
FIG. 35 is a front view of the stove of FIG. 14, compacted for transporting.

Another very advantageous feature of the design of the present stove is that is can be disassembled easily and all pieces neatly and compactly stowed away into main body 207 for transporting, as depicted in FIG. 35. As illustrated, there is plenty of room 370 for storing away cooking or kitchen utensils wrapped in protective sacks. Dry kindling wood is also stowable in the stove or the stove-pipe.

To pack the stove, springs 41 are first disconnected to release plates 230, 234 and 240 and rims 232, 236. Plate 230 is left in place as the top encloser of main body 207, and plate 240 is used to enclose the bottom. Rims 236, 238 are enclosed adjacent to plate 240, and plate 234 and rim 232 are placed on top. Then six springs 241 are connected to make three longer springs which are then hooked to the top and bottom encloser plates in the holes provided, to hold the plates to the main body. A waterproof carrying sack is preferably provided to protect the stove from exposure to moisture, thus preventing rust during transport or storage.

The fundamental concept and design of the stove are adaptable to optimally suit many purposes. Different gauges and types of metals are usable to obtain the quality, weight and durability desired. For example, when the stove is used in a tent or lodge, it is made in a range of sizes to suit the required heating and cooking needs of differently sized shelters. When used as a backpack stove, a smaller, simplified version is made—a lightweight, efficient and compactible wood stove that replaces the typical gas fuel stove now in use, avoiding the need to carry dangerous, heavy and costly fuel bottles. As a cabin or house stove, a larger, more elaborate stove is manufactured in heavier gauge metal with an enclosed, air-tight bottom and legs. When increased durability is required, a fire-brick lining is added. Such a stove is airtight, efficient, clean-burning and has excellent heat-radiating capabilities, plus ample cooking surface. In this embodiment, a thermostat control mechanism is also an option.

Having thus described the invention in considerable detail, it will be readily apparent to those skilled in the art that numerous modifications can be made without departing from the spirit and scope of the invention.

What is claimed is:

1. A ventilating system for a tepee comprising:

an uppermost portion of a wall of a tepee;

a substantially horizontally disposed opening defined by a top of said uppermost portion;

a support means disposed above a center of said opening; and a cone-shaped cap having a vertex, a base, a wall and a pivot point disposed on a top side of said wall a distance from said vertex, wherein said pivot point is rotatably supported by said support and wherein a bottommost portion of said base opposite from said pivot point rests on an outer annular surface of said uppermost portion such that said cap is rotatable about said support.

2. The ventilating system of claim 1 wherein said support means comprises at least one washer and a center pole of said tepee, said washer being disposed above said pole.

3. The ventilating system of claim 2, wheren said pole comprises an antenna and said cone-cap defines a pivot-hole at said pivot point, wherein said antenna projects upwardly through said washer and through said pivot-hole.

4. The ventilating system of claim 3, further comprising at least one additional washer and a securing means, said additional washer being disposed above said pivot-hole and said antenna projecting through said additional washer, whereby said securing means is disposed on said antenna and restricts upward movement of said additional washer.

5. The ventilating system of claim 4, wherein said securing means is an eye-screw.

6. The ventilating system of claim 1, wherein said pivot point is positioned such that said topside is substantially level.

7. The ventilating system of claim 1, wherein said cap extends horizontally beyond a periphery of said opening at all points of rotation.

8. The ventilating system of claim 1, further comprising fur sliders affixed to said cap at said bottommost portion.

* * * * *